US006918519B2

(12) United States Patent
Vor Keller et al.

(10) Patent No.: US 6,918,519 B2
(45) Date of Patent: Jul. 19, 2005

(54) SECURING MECHANISMS FOR PREVENTING ACCESS TO A FIREARM BY UNAUTHORIZED USERS, AND SAFETY HOUSING FOR USE THEREWITH

(75) Inventors: Albert W. Vor Keller, Marietta, GA (US); David R. Fletcher, Atlanta, GA (US); Robert C. Chinn, Atlanta, GA (US)

(73) Assignee: Safety First Devices, Incorporated, Atlanta, GA (US)

( * ) Notice: Subject to any disclaimer, the term of this patent is extended or adjusted under 35 U.S.C. 154(b) by 106 days.

(21) Appl. No.: 10/115,627

(22) Filed: Apr. 4, 2002

(65) Prior Publication Data

US 2002/0158095 A1 Oct. 31, 2002

Related U.S. Application Data

(63) Continuation-in-part of application No. 09/903,286, filed on Jul. 11, 2001, now Pat. No. 6,533,149, which is a continuation-in-part of application No. 09/826,111, filed on Apr. 4, 2001, now Pat. No. 6,588,635, which is a continuation-in-part of application No. 09/511,143, filed on Feb. 23, 2000, now Pat. No. 6,230,946.

(60) Provisional application No. 60/174,200, filed on Jan. 3, 2000.

(51) Int. Cl.[7] ..... F41C 33/02

(52) U.S. Cl. ..... 224/244; 224/188; 382/124

(58) Field of Search ..... 224/192, 191, 224/193, 198, 238, 243, 244, 913, 911; 382/115, 124; 206/1.5, 317

(56) References Cited

U.S. PATENT DOCUMENTS 3,942,691 A * 3/1976 Sisak ..... 224/275

4,309,065 A * 1/1982 Pappas ..... 312/242

(Continued)

FOREIGN PATENT DOCUMENTS

WO WO 00/65292 11/2000

OTHER PUBLICATIONS

Smart Biometrics, Inc. Homepage, By Bobbi Jo Fuller Charge Parent for Child's Crime? Internet Article, printed Jul. 15, 2002, www.smartbiometric.com.

www.123gunsafety.com, Imagine A Gun Safe That Works With The Touch of a Finger, Internet Article, printed Jul. 15, 2002.

Accimetrix Products and Services, www.accimetrix.com, Internet Webpage, printed Jul. 15, 2002.

(Continued)

*Primary Examiner*—Lien M. Ngo
(74) *Attorney, Agent, or Firm*—Gardner Groff, P.C.

(57) ABSTRACT

A securing mechanism for use in a holster, gun safe, base station, recharging/docking station, gun rack, or other safety housing for a firearm or other item, including one or more retaining members that engage the trigger guard, barrel, or other part of the firearm to prevent withdrawl of the firearm from the safety housing by anyone other than an authorized user of the firearm. The securing mechanism includes a biometric identification mechanism such as a fingerprint sensor for scanning fingerprint information of a prospective user of the firearm, and a processor for comparing the scanned biometric information with stored biometric information of an authorized user and releasing the retaining member only if the scanned biometric information matches that of the authorized user.

32 Claims, 27 Drawing Sheets

U.S. PATENT DOCUMENTS

| | | | | | |
|---|---|---|---|---|---|
| 4,909,053 | A | * | 3/1990 | Zipf et al. | 7/283 |
| 5,056,342 | A | * | 10/1991 | Prinz | 70/63 |
| 5,118,175 | A | * | 6/1992 | Costello | 312/242 |
| 5,172,575 | A | * | 12/1992 | Fisher | 70/63 |
| 5,236,086 | A | * | 8/1993 | MacTaggart | 206/317 |
| 5,275,317 | A | * | 1/1994 | Rogers et al. | 224/244 |
| 5,546,690 | A | | 8/1996 | Ciluffo | |
| 5,579,909 | A | | 12/1996 | Deal | |
| 5,598,151 | A | * | 1/1997 | Torii, Jr. | 340/5.33 |
| 5,636,464 | A | | 6/1997 | Ciluffo | |
| 5,701,770 | A | * | 12/1997 | Cook et al. | 70/63 |
| 6,260,300 | B1 | * | 7/2001 | Klebes et al. | 42/70.11 |
| 6,301,815 | B1 | | 10/2001 | Sliwa | |
| 6,320,975 | B1 | * | 11/2001 | Vieweg | 382/124 |
| 6,405,861 | B1 | * | 6/2002 | Siler et al. | 206/317 |
| 6,421,943 | B1 | | 7/2002 | Caulfield et al. | |
| 6,523,374 | B1 | | 2/2003 | Owens | |
| 6,532,399 | B2 | * | 3/2003 | Mase | 700/237 |
| 6,563,940 | B2 | | 5/2003 | Recce | |
| 6,570,501 | B2 | * | 5/2003 | Bushnell et al. | 340/542 |
| 6,622,534 | B1 | * | 9/2003 | Miller et al. | 70/92 |
| 6,641,009 | B2 | * | 11/2003 | French et al. | 224/244 |
| 6,788,997 | B1 | * | 9/2004 | Frederick | 700/236 |

OTHER PUBLICATIONS

Smith, Kerby C., "Who Needs a Smart Gun . . . Here's a Smart Holster! Michael's of Oregon unveils its Pro4 ID holster with a system that is as secure as a vault on the officer's belt," Handguns, Mar. 2001, pp. 56–59.

Metcalf, Dick, "A High–Tech Holster for the 21st Century! Uncle Mike's Pro4 ID," Shooting Times, Mar. 2001 pp. 24–44.

Michael's of Oregon Co., "Triple Retention Duty Holster with a patented Internal Lock," http://www.unclemike's.com/m holsters p.asp?grpky+23.

Smart Biometrics, Inc., "123 Gun Saftey Imagine a Gun Safe that Works with The Touch of a Finger," http://www.123gunsafety.com/.

Smart Biometrics, Inc., "Bio–Vault," http://www.smartbiometrics.com/pages/biovault.html.

Accimetix Products and Services, "Security Products," http://www.accimetrix.com/products/securityproducts.html.

"The Smart Holster," American Handgunner, Mar. 2001, p. 1.

* cited by examiner

SECURING MECHANISMS FOR PREVENTING ACCESS TO A FIREARM BY UNAUTHORIZED USERS, AND SAFETY HOUSING FOR USE THEREWITH

CROSS-REFERENCE TO RELATED APPLICATIONS

This continuation-in-part application claims the priority benefit of U.S. patent application Ser. No. 09/903,286 filed Jul. 11, 2001, U.S. Pat. No. 6,533,149, which is a continuation-in-part of U.S. patent application Ser. No. 09/826,111 filed Apr. 4, 2001, U.S. Pat. No. 6,588,635, which is a continuation-in-part of U.S. patent application Ser. No. 09/511,143, filed Feb. 23, 2000, U.S. Pat. No. 6,230,946, which claims the priority benefit of U.S. Provisional Patent Application Ser. No. 60/174,200, filed Jan. 3, 2000, the entire scope and content of which are hereby incorporated herein by reference.

TECHNICAL FIELD

The present invention relates generally to safety devices for weapons and, more particularly, to safety housings with a securing mechanism for preventing the use of a firearm by other than an authorized user of that firearm.

BACKGROUND OF THE INVENTION

Too many deaths and injuries are caused by unauthorized users gaining access to firearms. In many instances, it is the owner or authorized user of the weapon who is the victim of the shooting. For example, during a struggle between a police officer and a suspect, the suspect may gain control of the police officer's firearm and use it against the officer. Similarly, an intruder may gain control of a homeowner's firearm during a burglary and use the firearm against the homeowner. Children also sometimes gain access to firearms and unintentionally injure themselves or others. In order to prevent such tragic consequences, onto at least reduce their incidence, it is desirable to provide some type of safety device to prevent the use of a firearm by anyone other than an authorized user. However, it is also desirable that an authorized user not be prevented from quickly accessing and firing the firearm when necessary in an emergency.

For a number of reasons, many previously known safety devices have proven less than fully satisfactory in preventing unauthorized use of a firearm and/or render the firearm too inaccessible for potential emergency use. For example, typical trigger locks are unwieldy to remove, and are not suited for use when a firearm must be available for immediate access. Many previously known security holsters do not positively lock the firearm in the holster, but instead require that the firearm be pivoted or otherwise manipulated according to a known sequence to enable removal. Such devices may not be completely effective in preventing removal and use of a weapon by an unauthorized user who knows or successfully guesses the manipulation sequence. Other devices require a user to wear a transmitter or bar code on the hand or wrist, which is recognized by the device to permit access to a firearm. Such devices have been found inconvenient as they require a user to wear a glove or transmitter at all times in order to have access to the firearm, and also are not completely effective in preventing removal and use of a weapon by an unauthorized user who obtains access to the transmitter or bar code.

Accordingly, it can be seen that a need yet exists for a safety device for preventing unauthorized persons from accessing and using a firearm. A need further exists for such a device that nonetheless allows easy and fast access to a firearm by an authorized user. A need further exists for such a device that allows access to a firearm by an authorized user without the necessity of wearing special clothing or transmitters. It is to the provision of a device meeting these and other needs that the present invention is primarily directed.

SUMMARY OF THE INVENTION

The present invention advantageously prevents access to a firearm by unauthorized users, without significantly impeding immediate access by an authorized user. Briefly described, in a preferred form the present invention comprises a safety housing for a firearm such as a holster, docking and/or recharging station, gun rack, or gun safe. The safety housing has a chamber for receiving at least a portion of a firearm; a retaining member mounted within the chamber for movement between a first position for receiving and releasing a portion of the firearm and a second position for engaging a portion of the firearm to prevent removal of the firearm from the holster; locking means selectively operable between a locked position and an unlocked position, for selectively preventing movement of the retaining member from the second position to the first position; and a fingerprint or other biometric identification sensor operatively coupled to control the locking means to unlock the locking means upon identification of an authorized user, whereby the retaining member is free to move from the second position to the first position and permit removal of a firearm from the housing.

In another aspect, the present invention is a safety housing for a firearm, the safety housing comprising a lockable retaining member for engaging a portion of a firearm to prevent unauthorized removal of the firearm from the housing; and a fingerprint or other biometric sensor operatively coupled to unlock the retaining member upon identification of an authorized user.

In still another aspect, the present invention is a safety housing for a firearm, comprising a disk defining a notch, the notch adapted to cooperate with a cooperating portion of the firearm, the disk being rotational between a first position for receiving and releasing the cooperating portion of the firearm into and from the notch, and a second position for engaging the cooperating portion of the firearm within the notch to prevent withdrawal of the firearm from the housing; means for locking the disk in its second position; and means for identifying an authorized user of the firearm and releasing the locking means to permit withdrawal of the firearm from the housing.

In yet another aspect, the present invention is a housing with two (or another number) of pivotal retaining members arranged in a pliers-type configuration that cooperate to retain a portion of the firearm (such as the trigger guard) within the housing. The retaining members pivot between a first unlocked position and a second locked position. A pivotal lock member has lock arms that engage lock arms of the retaining members to secure the retaining members in the second locked position, thereby securing the firearm in the housing. When the lock member is pivoted to the first unlocked position, the retaining members permit the firearm to be withdrawn from the housing. An actuator such as a rotary or linear solenoid or a step actuator is provided to operate the lock member.

In still another aspect, the housing of the present invention is a holster comprising a shell defining a chamber for receiving at least a portion of a firearm, the shell having a top defining atop opening, a forward portion, and a rear portion, the rear portion including a lip projecting beyond the top to restrict unauthorized removal of an ammunition clip from a firearm retained within the holster.

In another aspect, the housing of the present invention is a gun rack for securing a rifle, shotgun or other long-barrel gun. In this form, the housing has a butt end cap, trigger-guard cover plates, and a securing mechanism mounted to a spine. The securing mechanism has at least one retaining member that restrains the barrel or another part of the firearm and one or more biometric identification devices such as fingerprint sensors for authenticating users.

In yet another aspect, the housing of the present invention is a gun safe having a base, a pivotal carrier for holding the firearm or the firearm and a portable holster, and a securing mechanism including at least one retainer member that engages the base to secure the carrier in the closed position. If the person is an authorized user as authenticated by a biometric identification device such as a fingerprint sensor, the retainers disengage the base so that the carrier drops to the open position under the force of gravity or by a spring, thereby exposing the gun and/or holster for removal.

In another aspect, the present invention is a method of preventing unauthorized use of a firearm, comprising placing the firearm within a housing, engaging a retaining member portion of the holster with a cooperating portion of the firearm, scanning a fingerprint or other biometric identifying body part or parts of a perspective user of the firearm, comparing the scanned information with biometric information of an authorized user of the firearm, and permitting removal of the firearm from the holster only if the scanned biometrics information matches the biometric information of the authorized user.

These and other objects, features, and advantages of the present invention will become more apparent upon reading the following description in conjunction with the accompanying drawing figures.

BRIEF DESCRIPTION OF THE DRAWING FIGURES

DETAILED DESCRIPTION OF THE PREFERRED EMBODIMENTS

Figure 1:
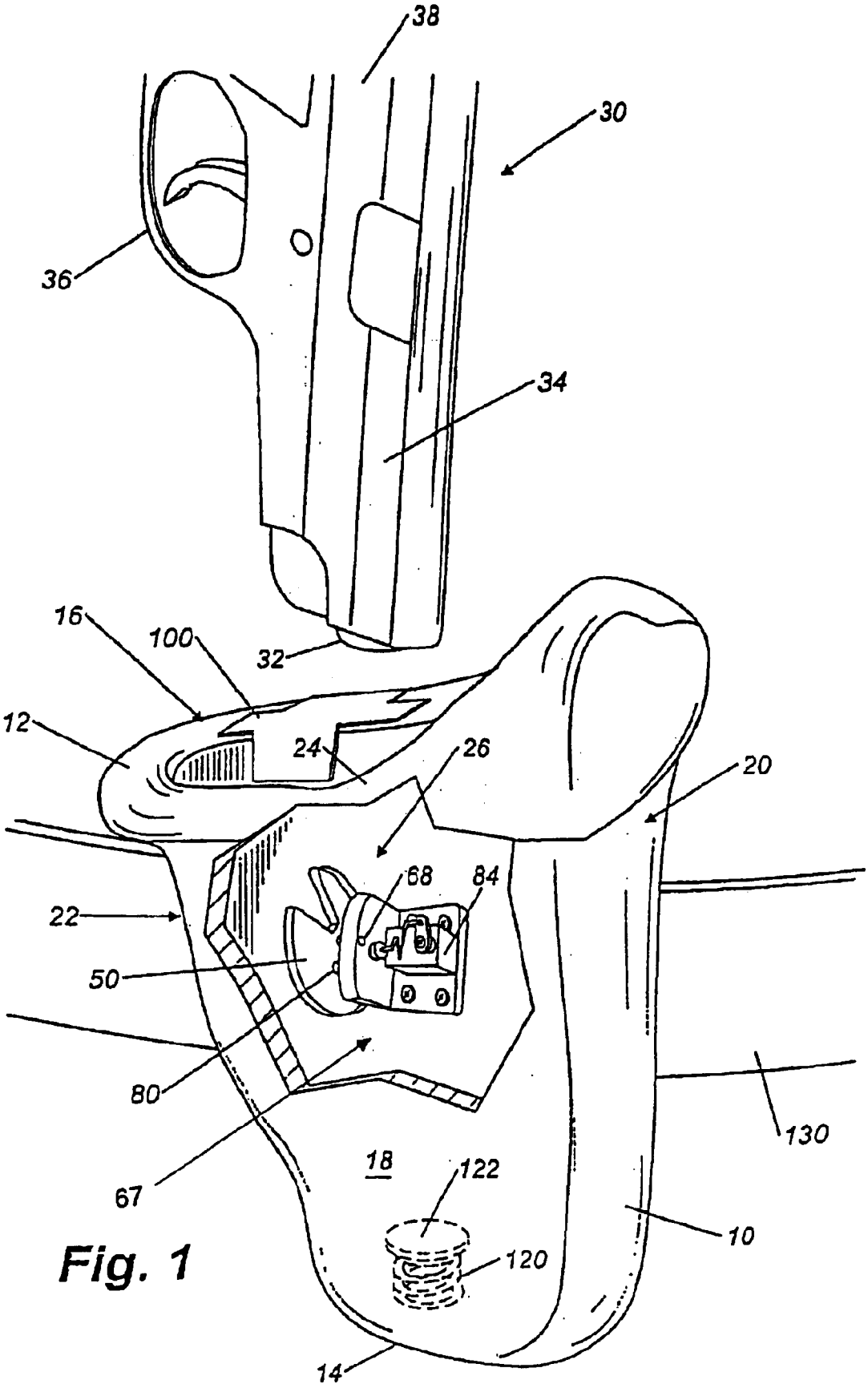
FIG. 1 is a perspective view, in partial cutaway, showing a safety holster with a securing mechanism according to one preferred form of the present invention.

Referring now to the drawing figures, wherein like reference numerals represent like parts throughout the several views, the present invention comprises a securing mechanism for locking a firearm to prevent access to the firearm by persons other than authorized users. In various embodiments described herein, the securing mechanism is implemented inside a safety housing having the general external configuration of a typical handgun holster, or another shape for receiving all or a portion of a handgun, and is adapted for preventing access to and/or operation of the trigger of the handgun held therein. In other embodiments described herein, the safety housing takes the form of a rack, shroud, sleeve, or other structure for preventing access to and/or operation of the trigger of a long gun such as a rifle or a shotgun. And in further embodiments, the safety housing has the form of a base station such as a docking and/or recharging station, a gun safe, or another structure for supporting a firearm.

Generally described, in preferred embodiments the securing mechanisms of the present invention comprise one or more retaining members for engaging a portion of a firearm, and a fingerprint sensor or other biometric device operatively coupled to release the retaining member upon identification of an authorized user. In this manner, the securing mechanisms of the present invention prevent removal and use of a firearm by anyone other than an authorized user, but allows an authorized user easy and virtually unrestricted access to the firearm.

Figure 2:
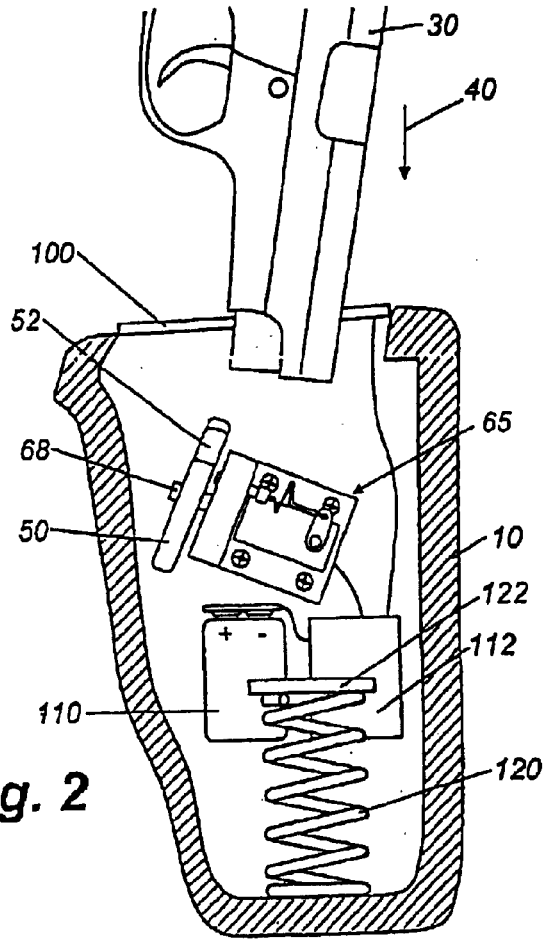
FIG. 2, is a side cross sectional view of the safety holster of FIG. 1 in a firearm-receiving orientation.
Figure 3:
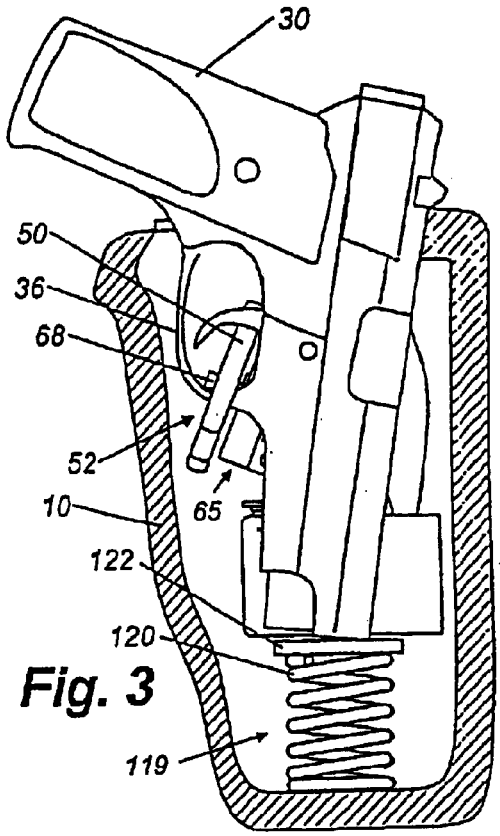
FIG. 3 is a side cross sectional view of the safety holster of FIG. 1 in a firearm-retaining orientation.

As seen best with reference to FIGS. 1–3, a first preferred embodiment of the present invention comprises a safety housing in the form of a holster 10 having a top 12, a bottom 14, an inside face 16, an outside face 18, a forward face 20 and a rearward face 22. The holster 10 is preferably formed of a plastic polymeric or composite material comprising an outer shell 24 defining a chamber 26 for receiving at least a portion of a handgun 30, typically the muzzle portion 32, the barrel 34 and the trigger guard 36, while leaving at least a portion of the handle and/or receiver portion 38 of the gun exposed for access by a user. Alternate materials of construction may include one or more of the following: steel, aluminum, titanium, and/or other metals, as well as various alloys and composites thereof; glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, glass or polymer fiber reinforced plastics, and/or various combinations of the foregoing.

The holster 10 is preferably a top draw holster, with the chamber 26 accessible through a top opening, whereby a handgun 30 is inserted generally in the direction of indicator arrow 40, and withdrawn in the opposite direction. Alternatively, the holster 10 may be designed to accommodate front, rear, or side withdrawal. For ease of use, the holster 10 preferably permits insertion and withdrawal of the firearm 30 without special manipulation. The shell 24 can be formed with one or more openings for drainage and/or ventilation in order to prevent the build-up of moisture that could cause corrosion of the firearm or holster components. It will be understood that the shell 24 can be provided of a material and with an exterior surface selected for use by itself, for use within another holster (e.g., in retrofit applications), or for use with other structures such as carrying cases and the like.

The holster 10 preferably further comprises a securing mechanism 67 with at least one retaining member 50 for engaging a portion of the firearm 30 to prevent unauthorized removal of the firearm from the holster. For example, the retaining member 50 may be configured to engage the trigger guard, the trigger, a safety latch or release, a clip release, a cylinder, a loading gate, a portion of the grip, a slide release pall, another portion of the firearm, and/or a combination of these. The retaining member 50 may be located in the safety holster adjacent the portion of the firearm to be engaged thereby. Furthermore, the location or position of the retaining member 50 in the holster may be selected for a particular type or size of firearm to be retained.

As shown in FIGS. 1–4, in a preferred embodiment, the retaining member 50 comprises a disk that is pivotally (i.e., rotationally) mounted within the chamber 26. In preferred form, at least one notch 52 is formed in the retaining member 50. Each notch 52 is preferably sized, shaped and oriented to receive and engage a cooperating portion of a firearm 30, preferably at or adjacent the trigger guard portion 36 of the firearm 30. In a preferred embodiment, the notch 52 spans an arc of between about 10° to about 45°. The retaining member 50 preferably pivots between a first position, depicted in FIGS 1 and 2, for receiving and releasing the trigger guard 36 or other cooperating portion of the firearm 30; and a second position, depicted in FIG. 3 for engaging the trigger guard 36 or other cooperating portion of the firearm 30 to prevent the unauthorized removal of the firearm from the holster. The retaining member 50 preferably traverses an arc of between 75° to 120°, and more preferably approximately 90°, in pivoting between the first position and the second position. The retaining member 50 is preferably an irregular (i.e., non-circular) element formed of a thin, rigid plate material such as, for example, 3/16" steel plate. Alternatively, the retaining member 50 can have an oval, triangular, polygonal, or other regular or irregular shape.

In a further preferred embodiment, the retaining member 50 is eccentrically mounted to pivot about an axis removed a distance from the center of mass of the retainer, whereby the notch 52 lies generally opposite the axis of rotation from the center of mass, and the retainer is weight-biased toward the above-described first position when the holster 10 is oriented with the top opening in an upward direction. In this manner, when the holster is worn by a user standing upright, the retaining member 50 is biased toward a position for receiving the firearm 30. Alternatively or additionally, the retaining member 50 can be biased toward the first position by spring, magnetic, or other biasing means.

Described in another manner, the retaining member 50 comprises a spaced pair of lobes or projections 54*a*, 54*b* (the space between the projections defining a notch such as the notch 52 in the above-described embodiment), with an engagement surface 55*a* and a catch surface 55*b*, respectively. As the firearm 30 is inserted into the holster 10, the forward outer face of the trigger guard 36 contacts the engagement surface 55*a* of the leading projection 54*a*, imparting rotation on the retaining member 50, and pivoting the catch surface 55*b* of the trailing projection 54*b* into engagement within the inner opening of the trigger guard. In alternate embodiments, the retaining member comprises one or more pivotally mounted fingers or longitudinally sliding bolts or latches mounted within the chamber 26 for engagement with a cooperating portion of the firearm 30.

More generally defined, the retaining member 50 comprises at least one cam, latch, bolt, projection, or other component with a catch surface, that moves rotationally, linearly, or otherwise into insertion into the trigger guard opening, or otherwise engages a firearm, and means for imparting movement to insert that component into the trigger guard opening or otherwise into engagement with a cooperating portion of the firearm. FIGS. 4A–4G depict several such alternative forms of the retaining member 50. It will be understood that the holster can be provided with a quantity of one or more than one of any particular type of retaining member, and/or with a combination of different types of retaining members, as may be desired.

Figure 4:
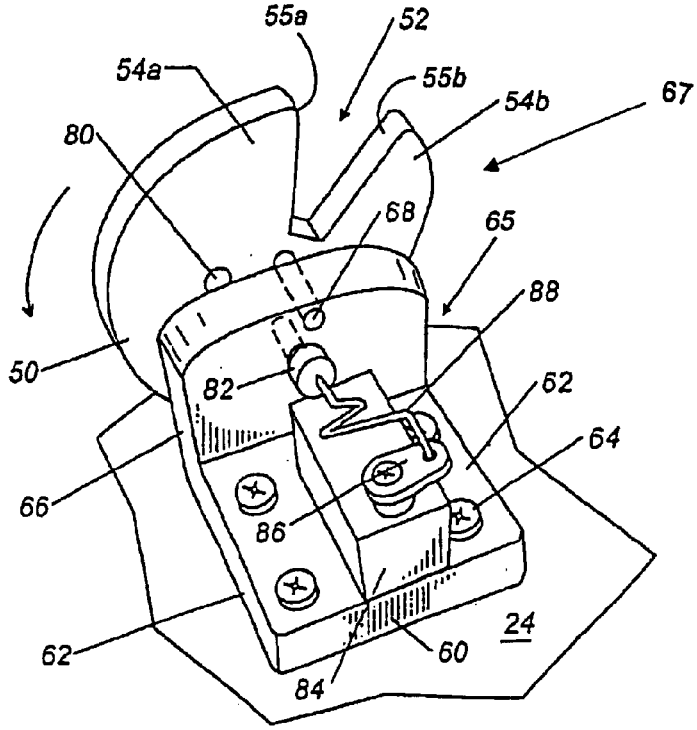
FIG. 4 is a perspective view showing greater detail of one retaining member and locking mechanism of the securing mechanism of FIG. 1.
Figure 4A:
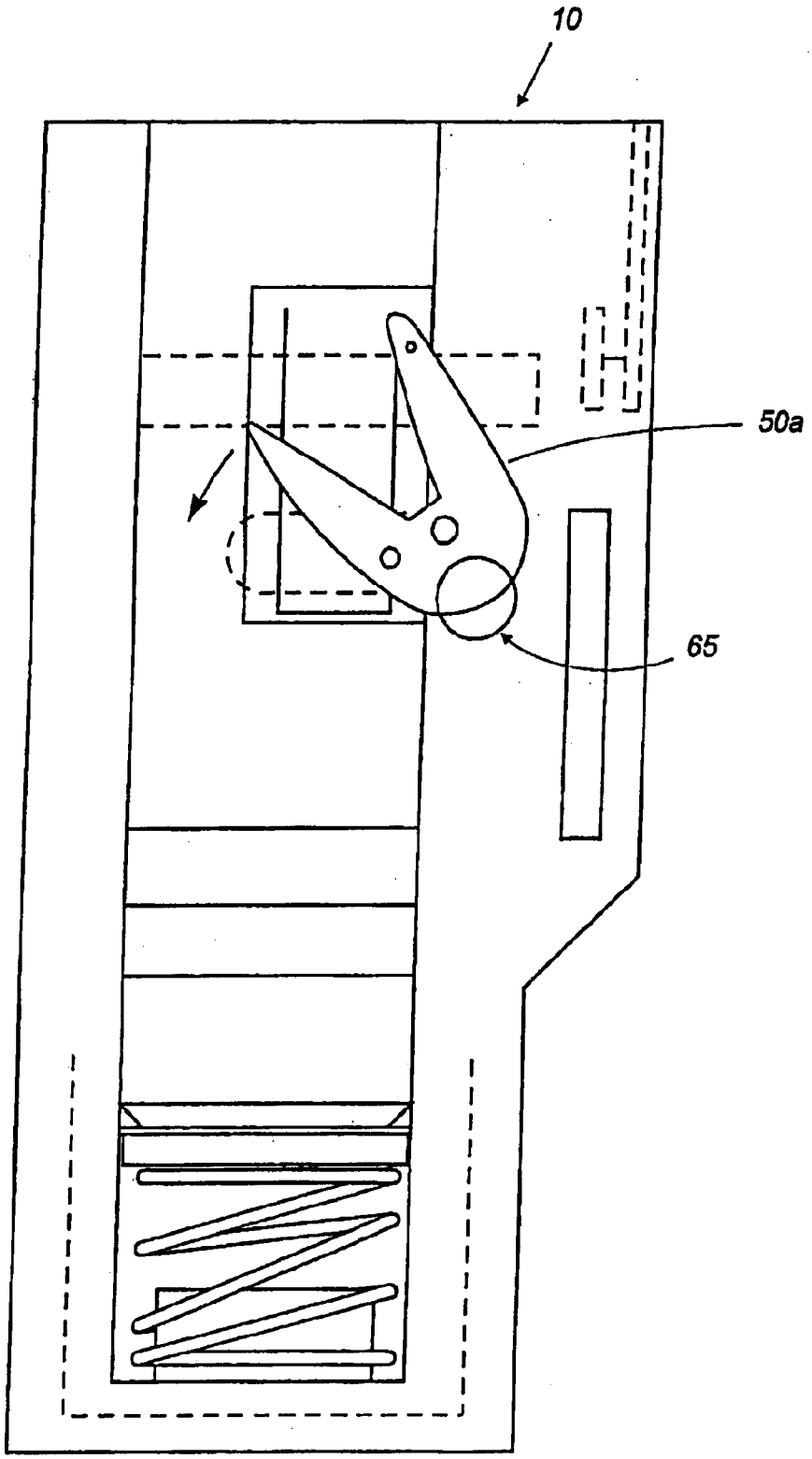
FIG. 4A is a front cross sectional view of the safety holster of FIG. 1 with an alternative retaining member having an elongate shape.
Figure 4B:
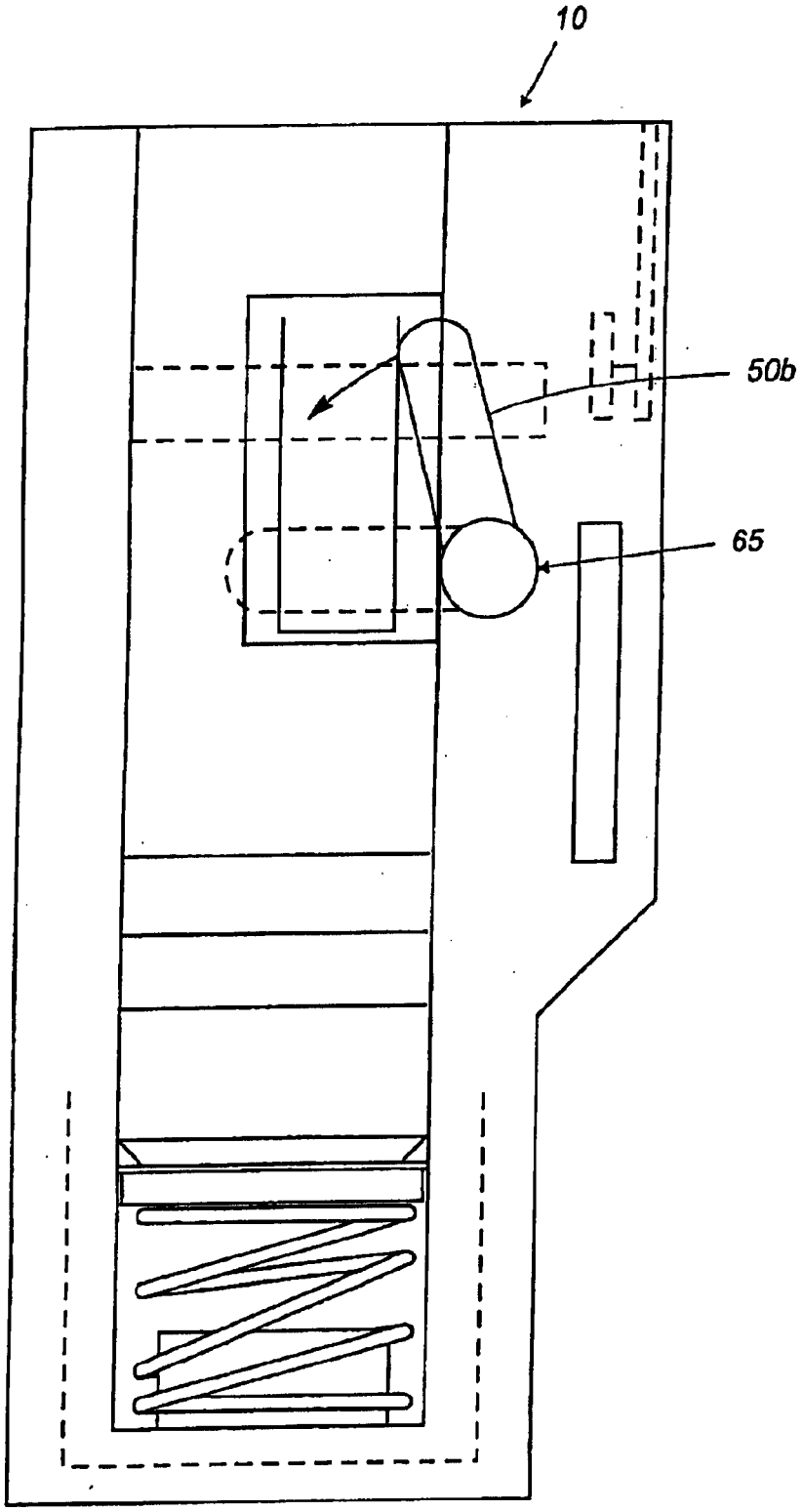
FIG. 4B is a front cross sectional view of the safety holster of FIG. 1 with an alternative retaining member provided by a pivotal cam.
Figure 4C:
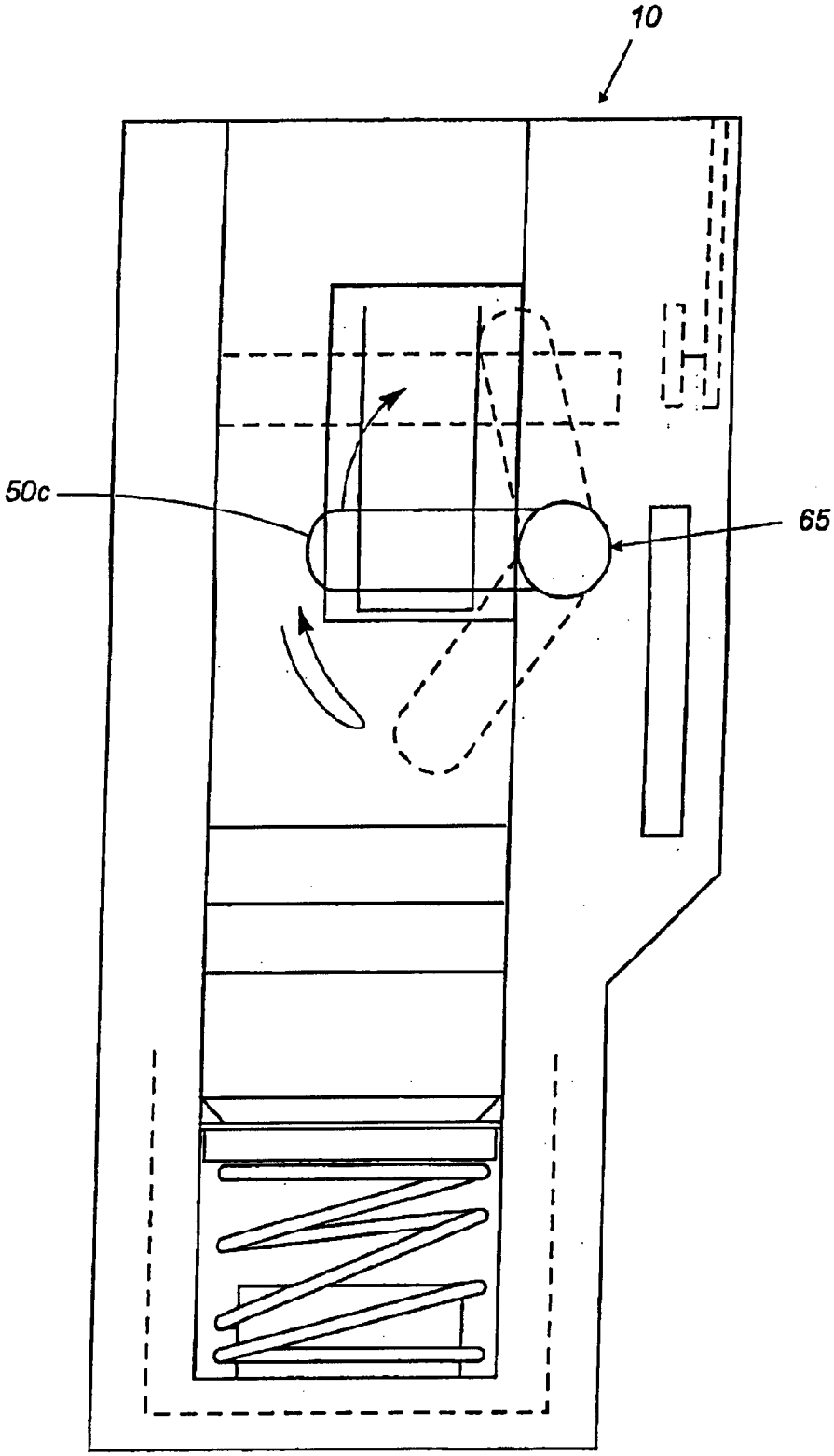
FIG. 4C is a front cross sectional view of the safety holster of FIG. 1 with an alternative retaining member provided by a spring-loaded pivotal cam.

In FIG. 4A, the retaining member 50*a* is very similar to the retaining member 50, except here the member has an elongate instead of a disk shape. In FIG. 4B the retaining member 50*b* is provided by a cam that pivots into and out of engagement with the trigger guard or another portion of the firearm. In FIG. 4C, the retaining member 50*c* is provided by a spring-loaded cam that pivots downward upon contact with the trigger guard or other portion of the firearm being inserted into the holster 10, and back up into the locked position after the guard clears the downwardly moved cam, and is then retracted rotationally upward to withdraw the firearm.

Figure 4D:
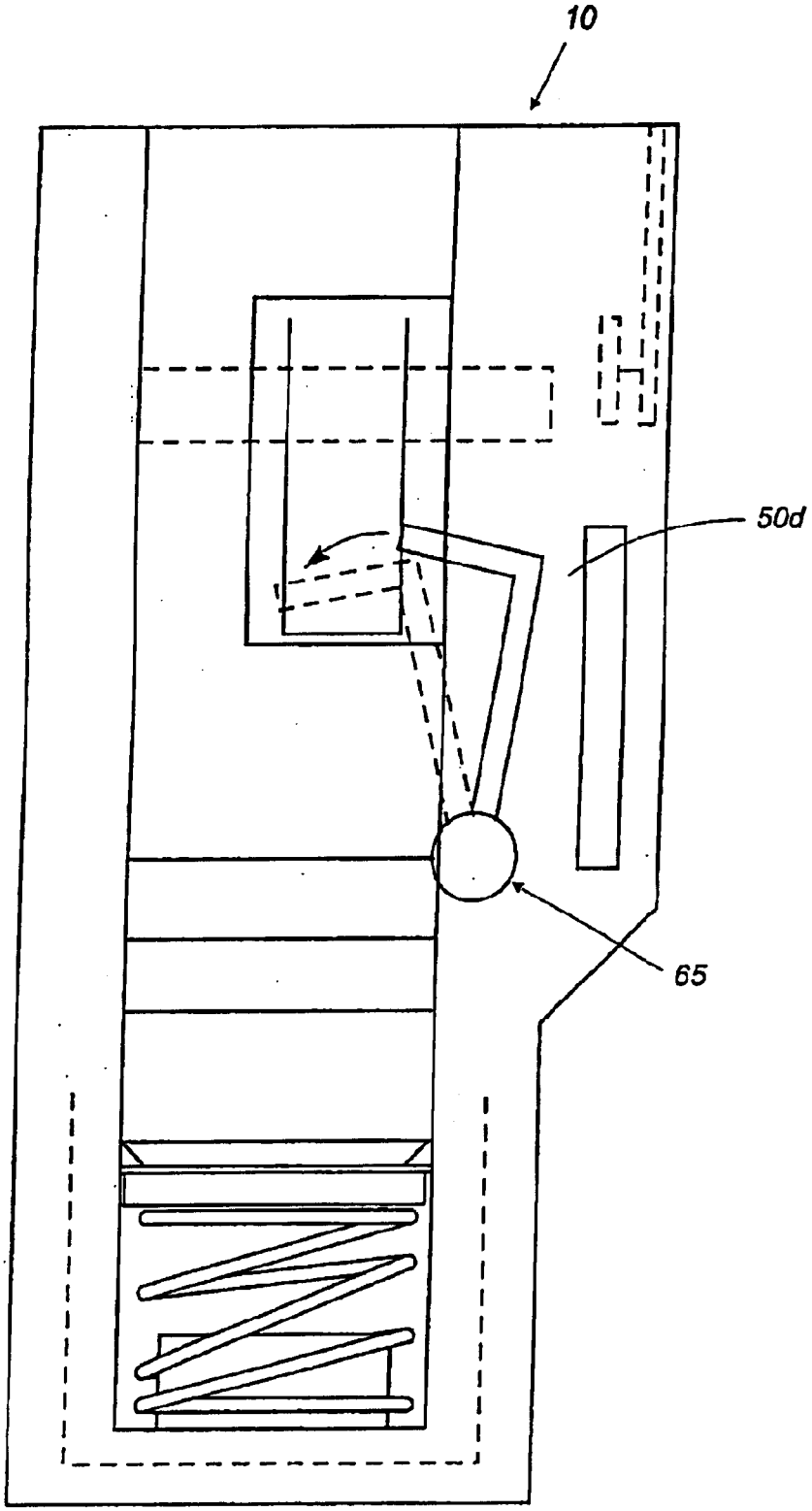
FIG. 4D is a front cross sectional view of the safety holster of FIG. 1 with an alternative retaining member provided by a rotary or pivotal latch.
Figure 4E:
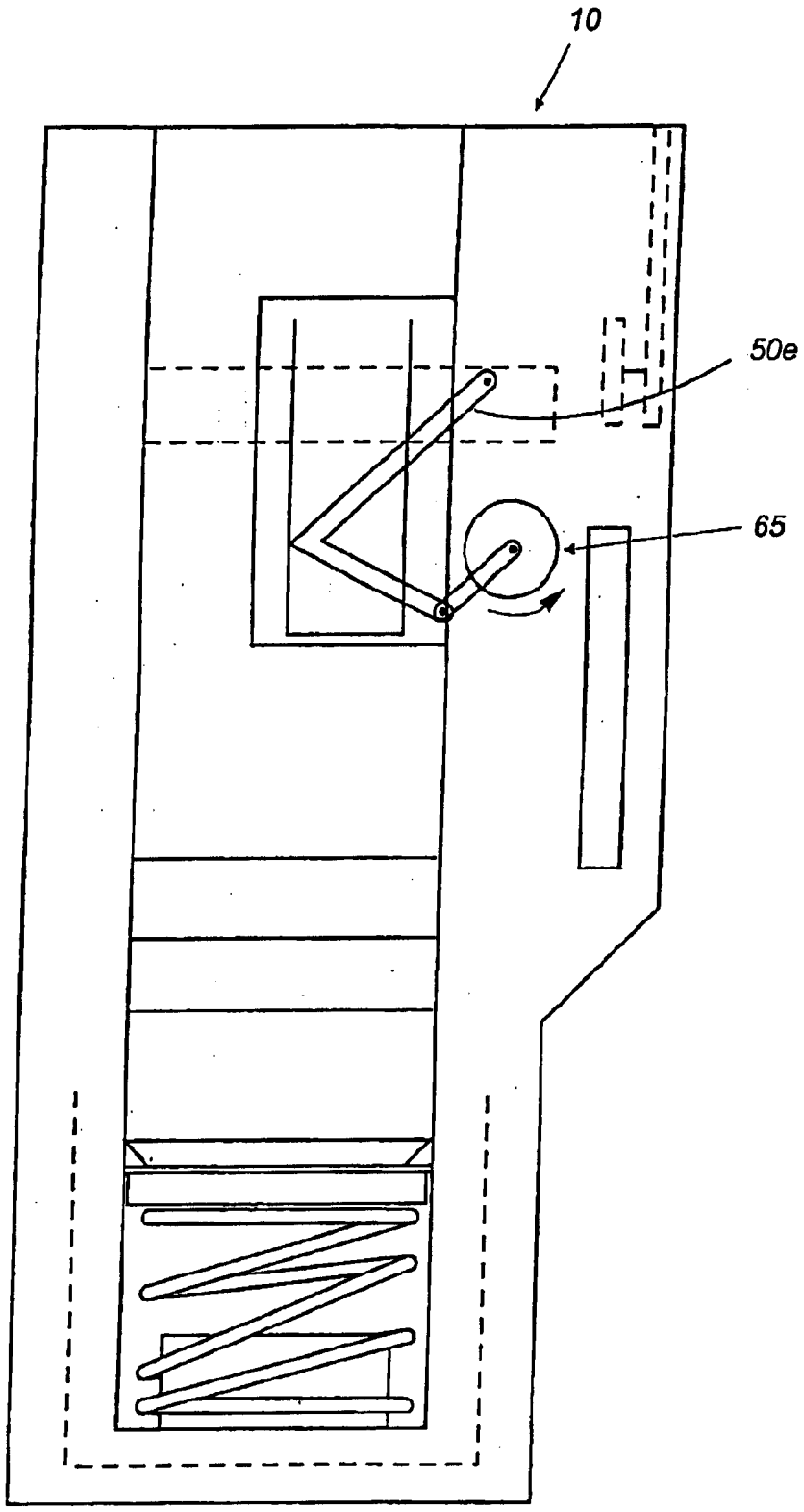
FIG. 4E is a front cross sectional view of the safety holster of FIG. 1 with an alternative retaining member provided by an L-shaped lever latch.
Figure 4F:
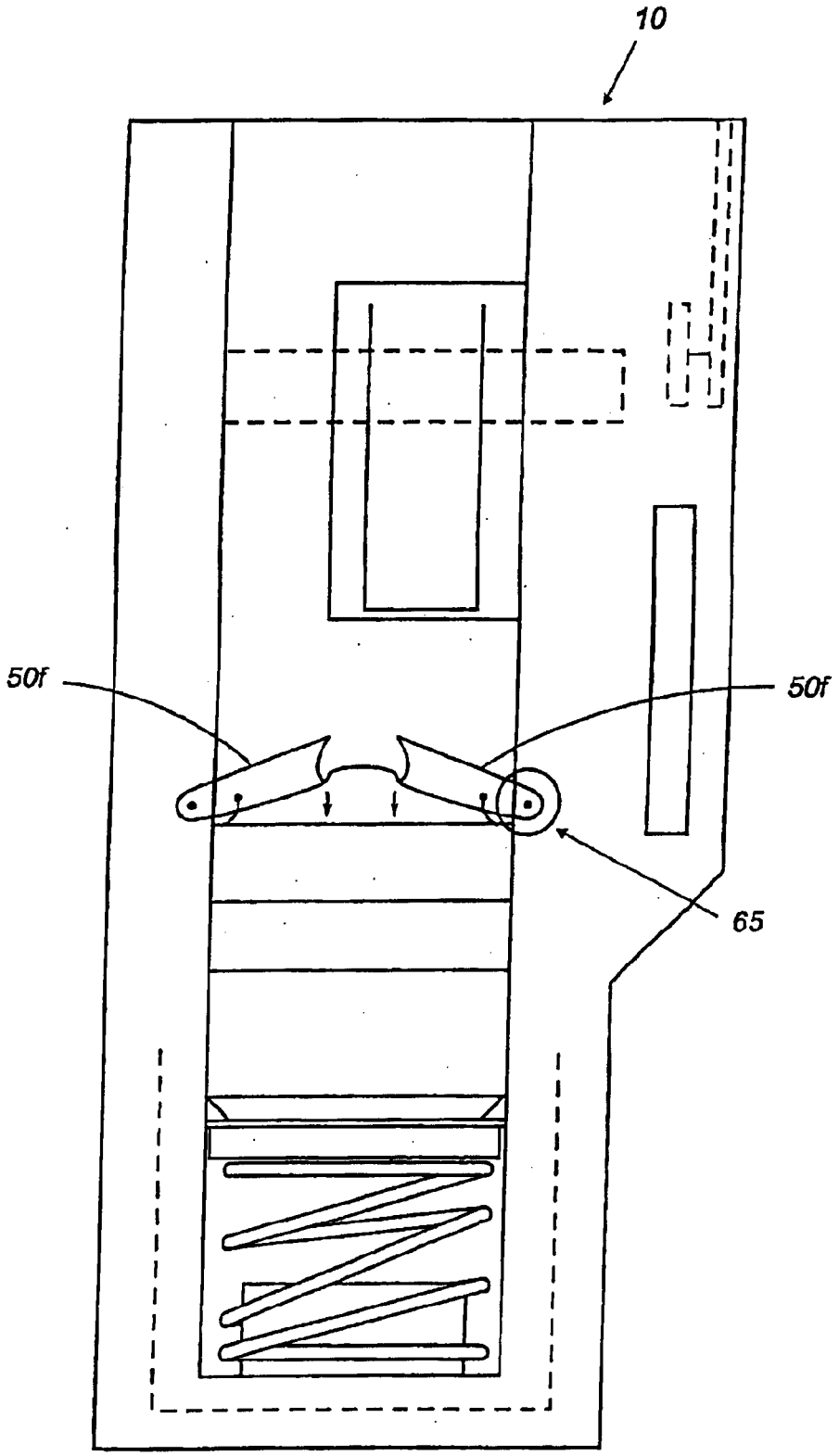
FIG. 4F is a front cross sectional view of the safety holster of FIG. 1 with an alternative retaining member provided by a set of spring-loaded cams 50*f*.
Figure 4G:
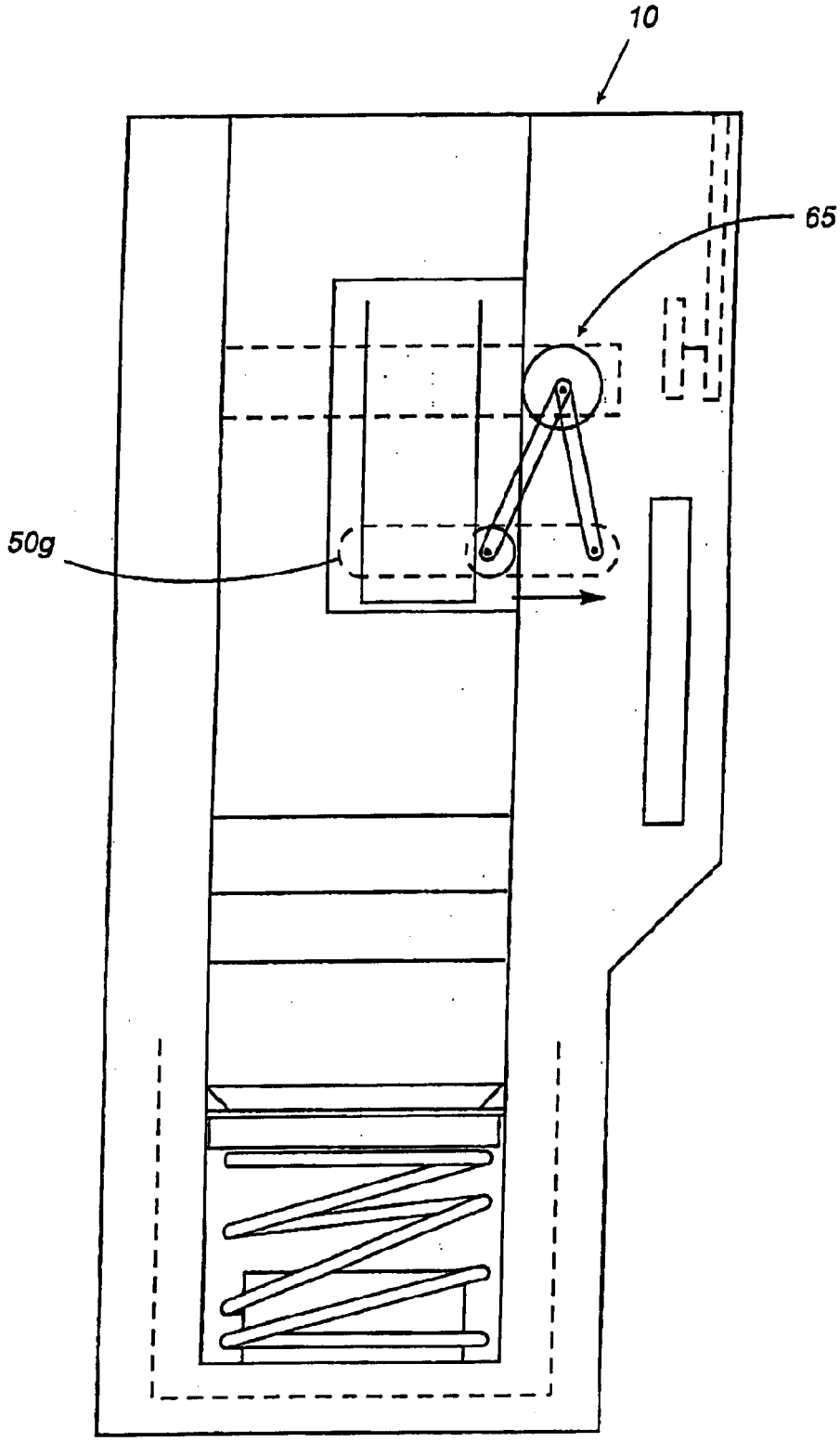
FIG. 4G is a front cross sectional view of the safety holster of FIG. 1 with an alternative retaining member provided by a slam latch or spring-biased latch.
Figure 4H:
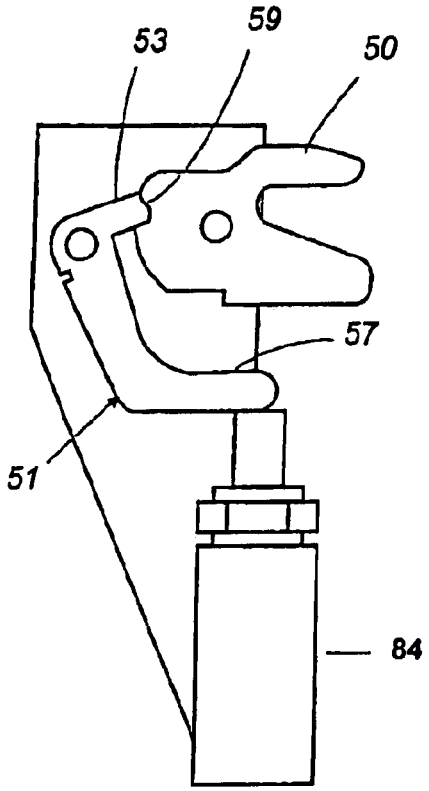
FIG. 4H is a side view of an alternative locking means having a pivotal lever with a head that locks the retainer in place and an arm operated by the drive means.
Figure 4J:
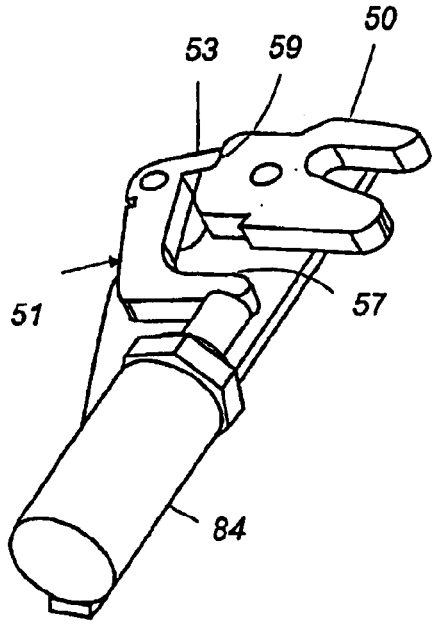
FIG. 4J is a perspective view of the locking means of FIG. 4H, showing the retainer in the second, engaged position.

In FIG. 4D, the retaining member 50*d* is provided by a rotary or pivotal latch with an end that rotates into and out of the trigger guard or another portion of the firearm. In FIG. 4E, the retaining member 50*e* is provided by an L-shaped lever with the corner of the "L" being positionable within the trigger guard or another portion of the firearm. The L-shaped lever is retracted therefrom to withdraw the firearm. In FIG. 4F, the retaining members 50*f* are provided by a set of spring-loaded cams 50*f* with a push-bar between them that, upon engagement with the trigger guard or other portion of the firearm, snaps the cams downward and together to catch the trigger guard in securely in place. The cams 50*f* are released to pivot upward under the force of the springs and/or by operation of a lock mechanism. In FIG. 4G, the retaining member 50*g* is provided by a slam latch or spring-biased latch with a latch bolt 50*g* (similar to a standard door latch) mounted to the holster 10, whereby contact between the trigger guard and the radiused or angled face of the latch bolt imparts retraction of the latch bolt and compression of the spring, and upon passage of the trigger guard over the face of the latch bolt, the spring imparts extension of the latch bolt into engagement within the trigger guard opening. The latch bolt 50*g* is then retracted by rotation of the locking mechanism 65.

In another alternate embodiment, the retaining member is provided by a bayonet lock in the form of a cylinder with a slot to receive some leading portion of the firearm as it was inserted into the holster. Upon contact with the bottom of the slot, the cylinder is released to rotate and engage secondary pins or slots. The cylinder is then released by operation of the solenoid, servo, electromagnet, other actuator, or other components of the lock mechanism.

In yet another alternate embodiment, a finger or other component can be caused to pivot or longitudinally extend into engagement with the trigger guard opening upon contact between the muzzle or other portion of the firearm with a strike plate or other contact surface within the holster. In one embodiment, the strike plate can also function as a lift surface component of a lift mechanism (described below), and is connected to the finger by one or more intermediate links, whereby insertion of the firearm into the holster depresses the strike plate, which is coupled by the linkage to impart movement of the finger or other component into the trigger guard opening.

The retaining member 50 is preferably rotationally mounted to a lug or projection formed integrally with the shell 24, or to a separate mounting bracket 60 attached to the shell within the chamber 26 of the holster 10. As seen best with reference to FIG. 4, in a preferred form, the mounting bracket 60 comprises a generally L-shaped component having a base panel 62 attached to the shell 24 by rivets, screws, adhesive or other attachment means 64. An upright panel 66 preferably extends generally perpendicularly from the base panel 62, away from the face of the base panel contacting the shell 24. An axle 68 is preferably provided for carrying the retaining member 50 and permitting rotation thereabout. The axle 68 preferably extends generally perpendicularly from the upright panel 66, opposite the base panel 62. In preferred form, the axle 68 is a pin having a generally circular cross-section and formed of steel or other substantially rigid material, and is carried within a through-hole formed at or adjacent the center of the disk 50. The retaining member 50 preferably rotates in a plane generally parallel to the upright panel 66, and generally perpendicular to the inside face 16 of the holster 10. The retaining member 50 is preferably mounted to the shell 24 in a position and orientation to result in rotation of the disk within a plane generally parallel to or at an acute angle relative to the direction of insertion and removal of the firearm 30 (indicated by direction arrow 40).

Referring back to FIGS. 1–4, the securing mechanism 67 of the holster 10 preferably further comprises a lock mechanism 65 that prevents movement of the retaining member 50 from the second, locked position to the first, released position, when the firearm 30 is held in the holster 10. In a preferred form, the lock mechanism 65 comprises locking means for preventing rotation of the retaining member 50 and having a recess or hole 80 formed in or through the retaining member 50, a pin 82 translationally mounted to the mounting bracket 60, and an actuator or drive means for advancing and retracting the pin 82 into and out of engagement with the hole 80. In one embodiment, the drive means comprises a servomotor 84 for pivotally driving a crank arm 86, which is in turn coupled to the pin 82 by a connecting link 88. According to a preferred form, the connecting link 88 comprises a spring or other compressible member for storing force when the retaining member 50 is rotated into a position whereby the hole 80 is not aligned with the pin 82 and motion of the pin 82 is thereby blocked from advancement. Then, upon rotation of the retaining member 50 into its second position wherein the hole 80 becomes aligned with the pin 82, the stored force imparts advancement of the pin 82 into the hole 80.

In alternate embodiments, the actuator or drive means comprises one or more solenoids in place of the servomotor 84 for advancing and/or retracting the pin 82. Of course, the drive means can be provided by another actuator known in the art and selected for the type of firearm and/or the desired release speed of the retaining member 50. The locking means can further comprise one or more springs acting to bias the pin 82 toward its advanced or retracted position. For example, a magnetically retracting solenoid can be provided in combination with a compression spring for extending the pin 82 into engagement with the retaining member 50. By appropriate coupling of springs or otherwise biasing the pin 82 toward its advanced or retracted position in the absence of force applied by the drive means, the device of the present invention provides a locked or unlocked "fail-safe" configuration, respectively. For example, in some instances, it will be preferable to configure the device to remain locked and prevent withdrawal of the firearm from the holster, even by an authorized user, in the event that the mechanism fails through loss of power or otherwise. In other instances, it may be desirable to unlock the device in the event of a failure condition, permitting withdrawal of the firearm from the holster, even by unauthorized users.

In alternate embodiments, the locking means comprises a ratchet and pawl mechanism, a slide bolt mechanism, a magnetic lock, a mechanical lock mechanism, or other linear or rotational releasable locking components for preventing release of the retaining member 50. Moreover, the locking means can comprise a portion of the retaining member 50 such as a one-way latch mechanism or other means for preventing removal of the firearm 30 from the holster 10 until released. Additionally or alternatively, the locking means can comprise a second notch (unshown) formed in the retaining member 50, and/or any combination of one or more pistons, levers or other components adapted to linearly engage another portion of the firearm 30. For example, the locking means can be configured to engage the trigger and trigger guard, the trigger guard and safety lever, the trigger and slide, or if the firearm is a revolver, the trigger guard and cylinder.

Figure 4I:
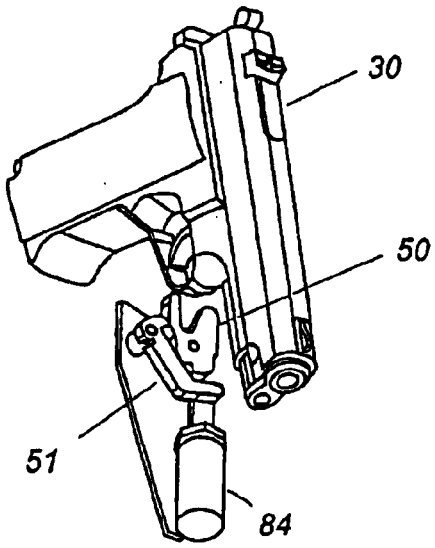
FIG. 4I is a perspective view of the locking means of FIG. 4H, showing the firearm and the retainer in the first, unlocked position.
Figure 4L:
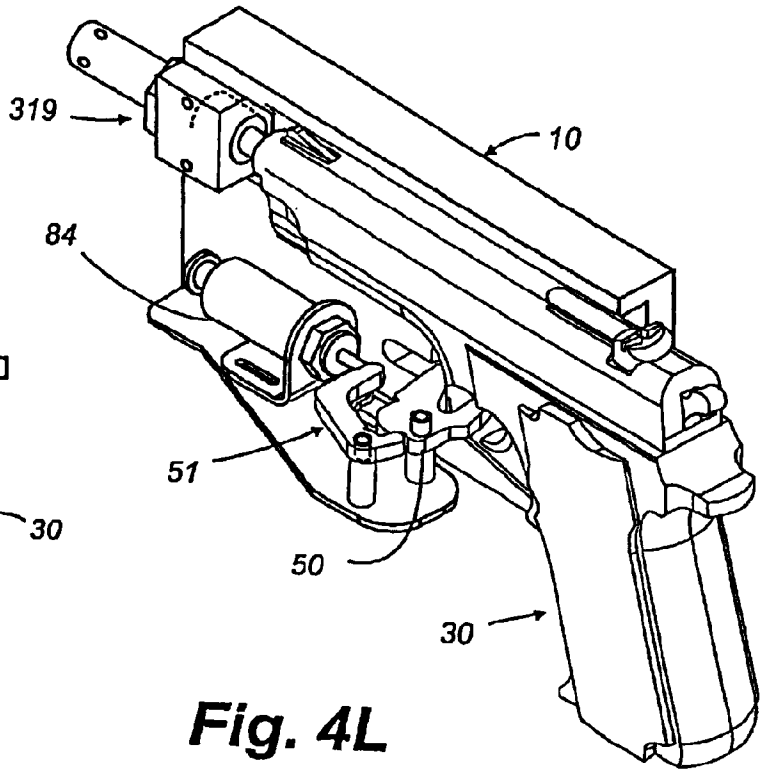
FIG. 4L is a perspective view of the locking means, retainer, and holster of FIG. 4K in use with the firearm in the holster.
Figure 4K:
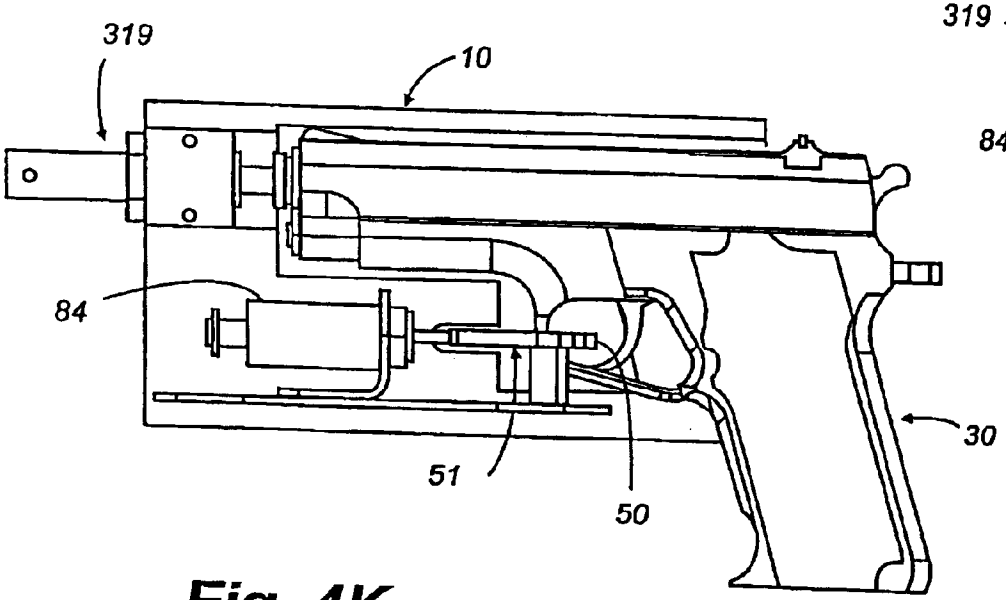
FIG. 4K is a side view of the locking means of FIG. 4H in use with the firearm in the holster, showing the retainer in the second, engaged position.

In another form shown in FIGS. 4H–4L, the locking means comprises a pivotal lock member 51 having an lock arm 53 and a drive arm 57, where the lock arm is receivable in a lock notch 59 in the retainer member 50 and the actuator or drive means 84 operates to engage the drive arm 57 and pivot the lock member 51. FIG. 4I shows the retainer 50 in the first, unlocked position, ready to receive the trigger guard or another portion of the firearm. As described above, the retainer 50 can be urged to the first position by providing the retainer with an eccentric shape or off-center pivot point so that it is weight biased towards this position, or by a spring or other mechanism. When the firearm is inserted into the holster, the trigger guard contacts the protrusions of the retainer 50 thereby causing the retainer to pivot into the second, engaged position shown in FIG. 4J. In this position, the lock arm 53 is seated in the notch 59 to lock the retainer in place and thereby lock the firearm 30 in the holster. When an authorized user is identified by the sensor (as described below), the actuator or drive means 84 (such as a solenoid) operates to extend a pin or other portion thereof into contact with the drive arm 57 to pivot the lock member 51. As the lock member 51 pivots, the lock arm 53 pivots out of the notch 59, freeing the retainer 50 to pivot and freeing the firearm top be withdrawn from the holster.

Referring back to FIGS. 1–4, in preferred form, the holster 10 of the present invention further comprises a biometric identification means 100 such as a fingerprint sensor or other biometric identification device such as a hand scanner, retinal scanner, facial recognition scanner, voice recognition device, and so forth. The identification means 100 is operatively coupled to the retaining member 50 so as to identify an authorized user and release the retaining member upon identification of an authorized user. In an example embodiment, the identification means 100 is a fingerprint sensor model AES3550 marketed by AUTHENTEC. In another example embodiment, the identification means 100 is a BIOCONTROLLER fingerprint sensor marketed by SMART BIOMETRICS, INC. of Longwood, Fla. In yet another embodiment, the identification means 100 is a FINGERCHIP thermal silicon chip fingerprint sensor, marketed by THOMSON-CSF, of Saint-Egreve, France, or the equivalent.

The identification means 100 is preferably mounted adjacent the top 12 of the holster 10, between the top opening and the inside face 16, whereby the user's thumb will automatically be positioned proximal the sensor 100 during withdrawal of the firearm from the holster when the holster is worn with its inside face toward the user's body. Alternatively, the sensor 100 is mounted adjacent the top 12 of the holster 10, between the top opening and the outside face 18, whereby the index, middle or other finger(s) of the user will automatically be positioned proximal the sensor 100 during withdrawal of the firearm from the holster when the holster is worn with its inside face toward the user's body. In further alternate forms, the sensor 100 is mounted on the outside face 18, elsewhere on the holster 10 where one or more fingers or a thumb of the user can be positioned for identification, and/or a plurality of the sensors can be provided for authorization and use by more than one user.

The identification means 100 can be permanently affixed to the holster 10, or can comprise a receiver and a removable identification card, a chip, or another component, which can be removed to permanently disable the system and prevent withdrawal of the firearm 30 from the holster 10. For example, a smart card with a sensor and chip, such as that provided by FINGERPRINT AB of Sweden, can be inserted in a slot, such as slot 11 in FIG. 4A. In alternate embodiments, other forms of identification means, such as a coded keypad, bar code scanner, receiver, cornea or other eye-part sensor, facial or other body part sensor, palm reader, voice recognition system, thermal or ultrasonic imaging device, secret release button, or combinations thereof, can be provided in place of the fingerprint sensor. The identification means 100 can be configured to identify and permit access to the firearm by only a single user, or alternatively by two or more authorized users. If a removable identification means is provided, it may be configured for installation and use in only a single holster 10, or for use in any of a plurality of holsters.

A power source 110 such as a battery is preferably provided for energizing the drive means 84 and the fingerprint sensor 100. The power source 110 is preferably rechargeable (though disposable batteries can be suitably employed), and is configured to cooperate with a recharging station as described below. A microprocessor-based programmable controller 112, such as for example, a MOTOROLA DSP56309 digital signal processor, an OXFORD MICRO DEVICES, INC. A236 video digital signal processor (DSP) chip, an OXFORD MICRO DEVICES, INC. A336FP fingerprint and image compression DSP chip, or equivalent, is also preferably provided, and is preferably powered by the power source 10. The controller 112 is preferably programmed and encrypted prior to assembly of the holster 10, and preferably further comprises sufficient memory for storing input fingerprint or other biometric information of one or more authorized users.

In an example embodiment, the controller 112 preferably comprises a DSP chip and non-volatile memory, and is coupled to the fingerprint sensor or scanner 100. One or more signal amplifiers, transformers, additional programmable controllers, and/or other components may be provided, as desired for a particular component configuration, as can be readily determined by one of ordinary skill in the art. Information regarding the configuration of example forms of the controller 112 and associated components may be obtained from the manufacturers of a particular component, and configuration and set-up parameters are within the level of skill in the art. See, for example: *Data Sheet Summary, A236 Video Digital Signal Processor Chip*, (Oxford Micro Devices, Inc., http://www.oxfordmicrodevices.com/a236-sum.html); and/or *Application Notes for Fingerprint Processing Using the A336FP Fingerprint and Image Compression Digital Signal Processor DSP Chip*, (Oxford Micro Devices, Inc., http://www.oxfordmicrodevices.com/a336fpadv.html), each of which are incorporated herein by reference. For example, the controller 112 can be provided by processor model MV1200 marketed by BIOSCRYPT of California.

The controller 112 preferably stores input fingerprint or other biometric identification information of one or more authorized users in its memory and compares the identification information scanned into the fingerprint sensor 100 with the stored identification information of authorized users to determine whether a person attempting to use the firearm is or is not an authorized user. If the scanned fingerprint or other biometric information matches that of an authorized user, the controller 112 signals the locking means to unlock and release the retaining member, permitting rotation of the retaining member from the second position to the first position, whereby the firearm can be withdrawn from the holster. If the scanned information does not match that of an authorized user, the controller sends no signal to the locking mechanism 65, or signals the locking mechanism 65 to remain locked, and the retaining member 50 remains locked in the second position, whereby the firearm 30 cannot be withdrawn from the holster 10.

The holster 10 of the present invention can be configured for use according to one or more different modes of operation. In a first mode of operation, upon recognition of an authorized user's fingerprint or other biometric information, the locking means is unlocked and remains unlocked until the firearm is withdrawn from the holster. For example, in the depicted embodiment, upon recognition of an authorized user, the controller 112 signals the solenoid or servomotor 84 to retract the pin 82 out of engagement with the hole 80, permitting the disk 50 to be rotated freely from its second position (FIG. 3) to its first position (FIG. 2). The pin 82 remains in its retracted position until the firearm 30 is withdrawn from the holster 10. Upon release of the locking means, the firearm may be raised a small distance within the holster by the spring lift mechanism (described below), if provided, to facilitate easier withdrawal of the firearm from the holster. Withdrawal of the firearm 30 from the holster 10 can be indicated by one or more sensors or microswitches provided on the retaining member 50 or elsewhere on the holster.

According to another mode of operation, upon recognition of an authorized user's fingerprint information, the locking means is unlocked for a predetermined period of time and, if the firearm is not withdrawn from the holster during this period of time, the locking means relocks. For example, in the depicted embodiment, upon recognition of an authorized user, the controller 112 signals the servomotor 84 to retract the pin 82 out of engagement with the hole 80, permitting the disk 50 to be rotated freely from its second position (FIG. 3) to its first position (FIG. 2). The pin 82 remains in its retracted position for a predetermined duration of between less than one second to about fifteen seconds, and most preferably about one to three seconds. A timer within the controller 112 preferably measures the predetermined period of time, and after this period has elapsed, the controller signals the servomotor 84 to advance the pin 82 back into engagement with the hole 80. One or more sensors or microswitches can be provided to signal the controller 112 that the retaining member 50 has moved out of its second position by means of withdrawal of the firearm 30 from the holster 10, whereupon the controller will not signal the servomotor 84 to advance the pin 82 until the retaining member 50 returns to its second position. Alternatively, and as described in greater detail below, if the locking means comprises a compressible member, the controller 112 can activate the servomotor 84 to advance for re-engagement of the locking means without regard to the position of the retaining member 50, and the pin 82 will automatically advance into engagement with the hole 80 when the retaining member 50 returns to its second position. This embodiment eliminates the need for sensors or microswitches to monitor the position of the retaining member 50.

In preferred form, the retaining member is biased toward its first position by biasing means as discussed above when the locking mechanism 65 is unlocked and the firearm 30 is withdrawn from the holster 10. In this manner, the holster remains configured for receipt and re-engagement of the firearm when it is eventually replaced into the holster. If the locking mechanism 65 comprises a compressible member or other force-storing means, as described above, the controller 112 can be configured to activate the locking mechanism upon withdrawal of the firearm 30 from the holster 10, or after a predetermined period of time has elapsed. In this manner, energy stored in the compressible member will cause the locking mechanism 65 to automatically reengage upon replacement of the firearm 30 into the holster 10.

For example, in the above-described embodiment, the retaining member 50 remains in its first position (FIG. 2), preferably by means of weight bias, after the firearm 30 has been withdrawn from the holster 10. In this position, the notch 52 of the retaining member 50 faces toward the opening in the top 12 of the holster 10, and the holster is configured to receive the firearm when it is replaced back into the holster. The controller 112 signals the servomotor 84 to activate and pivot the crank arm 86 in the direction of the retaining member 50. Because the hole 80 is not aligned with the pin 82, advance of the pin is blocked by the retaining member 50, resulting in compression of the connector link 88, causing energy to be stored in the compressed connector link. Contact between the pin 82 and the retaining member 50 under the influence of the compressed connector link also assists somewhat in maintaining the retaining member 50 in its first position, ready for replacement of the firearm 30 in the holster 10.

As the firearm 30 is replaced back into the holster 10, the trigger guard 36 is received within the notch 52 of the retaining member 50. Downward movement of the firearm 30 into the chamber 26 of the holster 10 toward the bottom 14 causes the retaining member 50 to rotate upon contact with the trigger guard 36 into the second position (FIG. 3) wherein the notch 52 faces generally downwardly toward the bottom 14 of the holster. As the retaining member 50 rotates into the second position, the hole 80 is brought into alignment with the pin 82. Force imparted by the compressed link then advances the pin 82 into the hole 80, locking the retaining member 50 in the second position. In this configuration, the trigger guard 36 of the firearm 30 is engaged within the notch 52 and the retaining member 50 is locked against rotation, preventing the firearm from being removed upwardly from the holster. The shell 24 of the holster 10 prevents the firearm 30 from being moved downwardly or sideways to an extent sufficient to allow the trigger guard 36 to be released from the notch 52. As a result, the firearm is securely retained and positively locked in the holster until the locking means is disengaged.

The holster 10 preferably further comprises a lift mechanism 119 for spring-biasing or otherwise raising the firearm 30 at least a small distance (e.g., ¼" to ⅜", or more or less) within the holster upon disengagement of the locking mechanism 65. For example, the lift mechanism 119 can comprise a spring 120 that is preferably mounted against the bottom 14 within the chamber 26 of the holster 10. A padded lift surface 122 is carried by the spring 120 to contact the muzzle 32 of the firearm 30 and transmit force from the spring to the firearm without marring the surface finish of the firearm. Upon release of the locking mechanism 65, the lift mechanism 119 raises the firearm upwardly in the holster 10 to provide tactile feedback to the user that the firearm 30 has been released, and to facilitate drawing the firearm from the holster. The spring or other lift mechanism 119 preferably provides about 1–1½ lb. or another amount of lift. The lift mechanism 119 can optionally be adjustable to conform to the length and/or weight of a particular firearm, and/or to selectively vary the desired extent of lift provided. An alternative lift mechanism is described below with reference to FIGS. 10–13.

The holster 10 preferably further comprises one or more attachment points for attaching the holster to a belt 130 of a wearer. For example, one or more slots may be formed in or adjacent the inside face 16 for receiving a belt. Alternatively, the holster 10 can comprise a clip or hook adapted to be clipped over a belt. In a further alternate embodiment, one or more quick-disconnect couplings can be provided on or adjacent the inside face 16 of the holster 10, and cooperating coupling(s) provided on a belt or on a carrier worn on a belt. Provision of quick-disconnect couplings advantageously permits the user to remove the holster for comfort, for example during driving, or for recharging of the power source, without removing the belt. In further alternate embodiments, the holster 10 can comprise an integral belt, or can comprise one or more connections for attachment to a chest or ankle harness, or a waistband; or for otherwise securing the holster to a user or the user's apparel. Typically, the inside face 16 of the holster 10 is worn against or adjacent the user's body.

Figure 5:
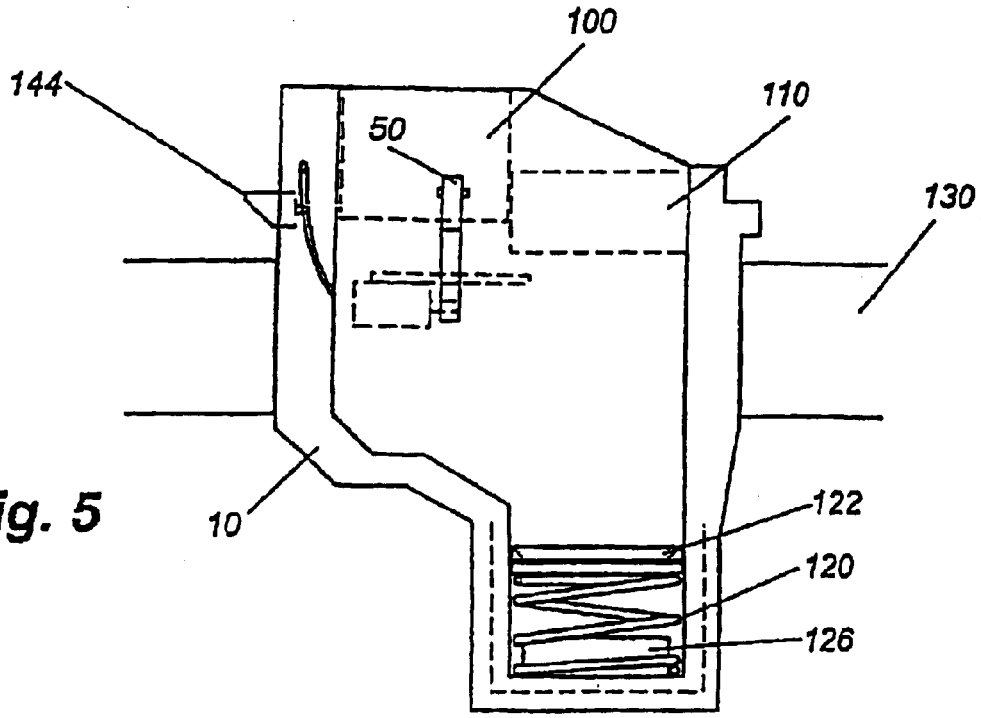
FIG. 5 is a side cross sectional view of a safety holster according to another preferred form of the present invention.
Figure 6:
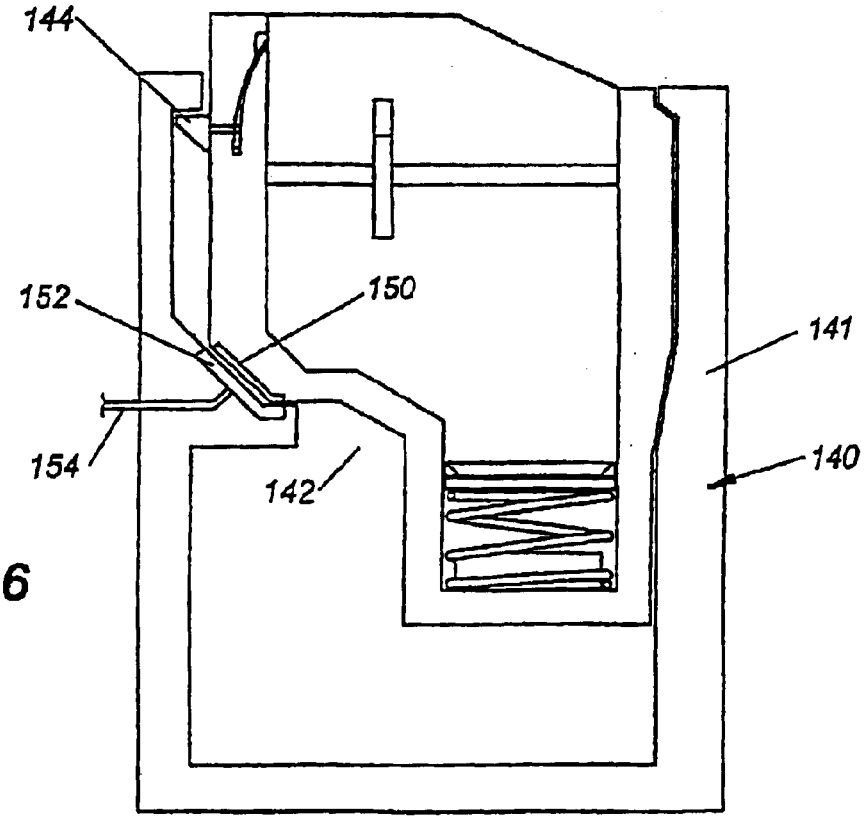
FIG. 6 is a side cross sectional view of a safety holster received in a recharging/docking station according to another preferred form of the present invention.

As seen with particular reference to FIGS. 5 and 6, the present invention preferably further comprises a base station such as a recharging station or docking bay 140 for recharging the battery or other portable power source 110 of the holster 10. The recharging/docking station 140 preferably comprises a base 141 having one or more recessed portions, projections, or coupling points for releasably engaging the holster 10. In preferred form, the recharging/docking station 140 comprises a recess 142 generally matching the outer geometry of the holster 10 or a portion thereof, whereby the holster is placed within the recess 142 for secure engagement during recharging. The recharging/docking station 140 preferably comprises two or more contact points 152 for electrical contact with cooperating contact points 150 provided on the holster 10. One or more springs or other means for maintaining electrical contact between the cooperating contact points of the recharging station 140 and the holster 10 can be provided.

The recharging/docking-station 140 preferably further comprises a power source or a connection, such as a power cord 154, for receiving power from an external source. The recharging/docking station 140 can be portable, or can be permanently or releasably affixed to a non-portable base surface. The recharging/docking station 140 preferably comprises locking means 144 for engaging and positively locking the holster 10 in the docking station to prevent unauthorized removal during charging and/or storage. For example, the recharging station 140 can be permanently affixed in the trunk or passenger compartment of a vehicle by the station locking means 144, thereby permitting law enforcement users to securely lock the holster (and if desired, a firearm within the holster) to the vehicle when off duty. The locking means of the recharging station 140 can comprise fingerprint identification means, an alphanumeric keypad, a keyed or combination lock, another biometric identification mechanism, or other means for selective release of the holster by an authorized user. Additionally or alternatively, the locking means of the recharging station can cooperate with the fingerprint scanner 100 or other identification means of the holster for verification of an authorized user and release of the locking means of the recharging station.

Figure 6A:
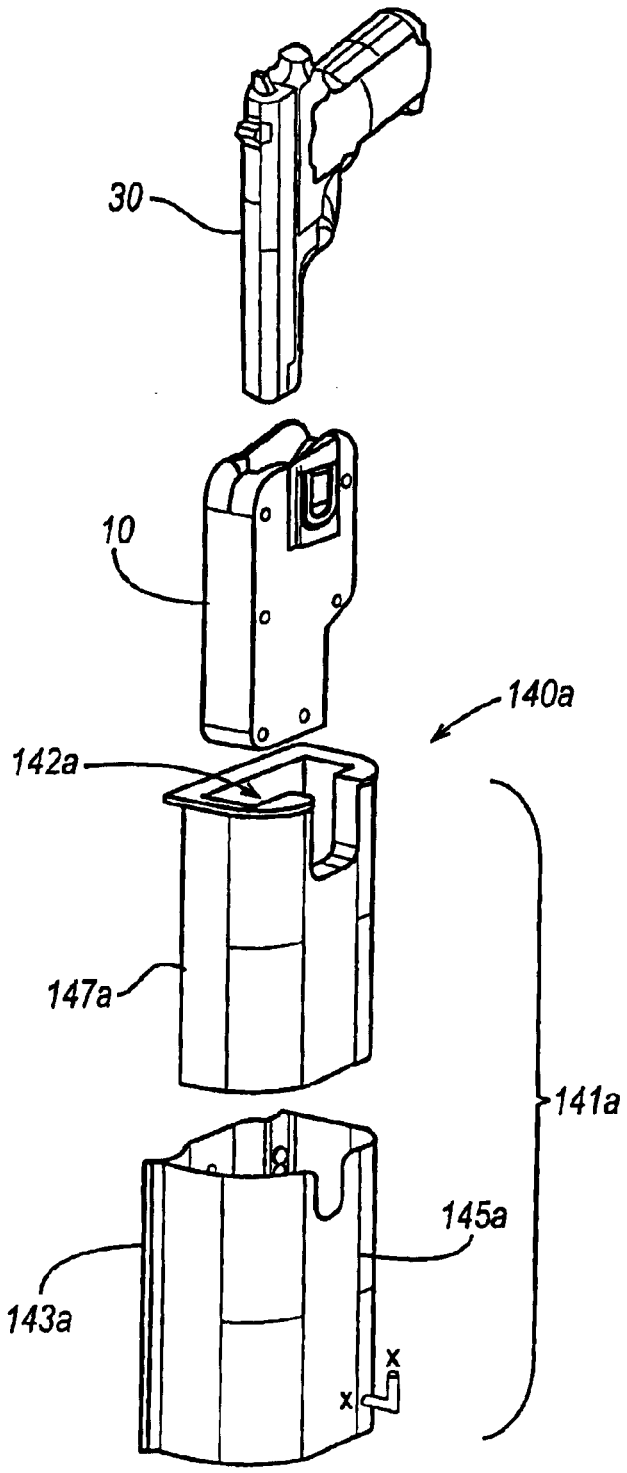
FIG. 6A is an exploded perspective view of a safety holster and another preferred form of the recharging/docking station.
Figure 6B:
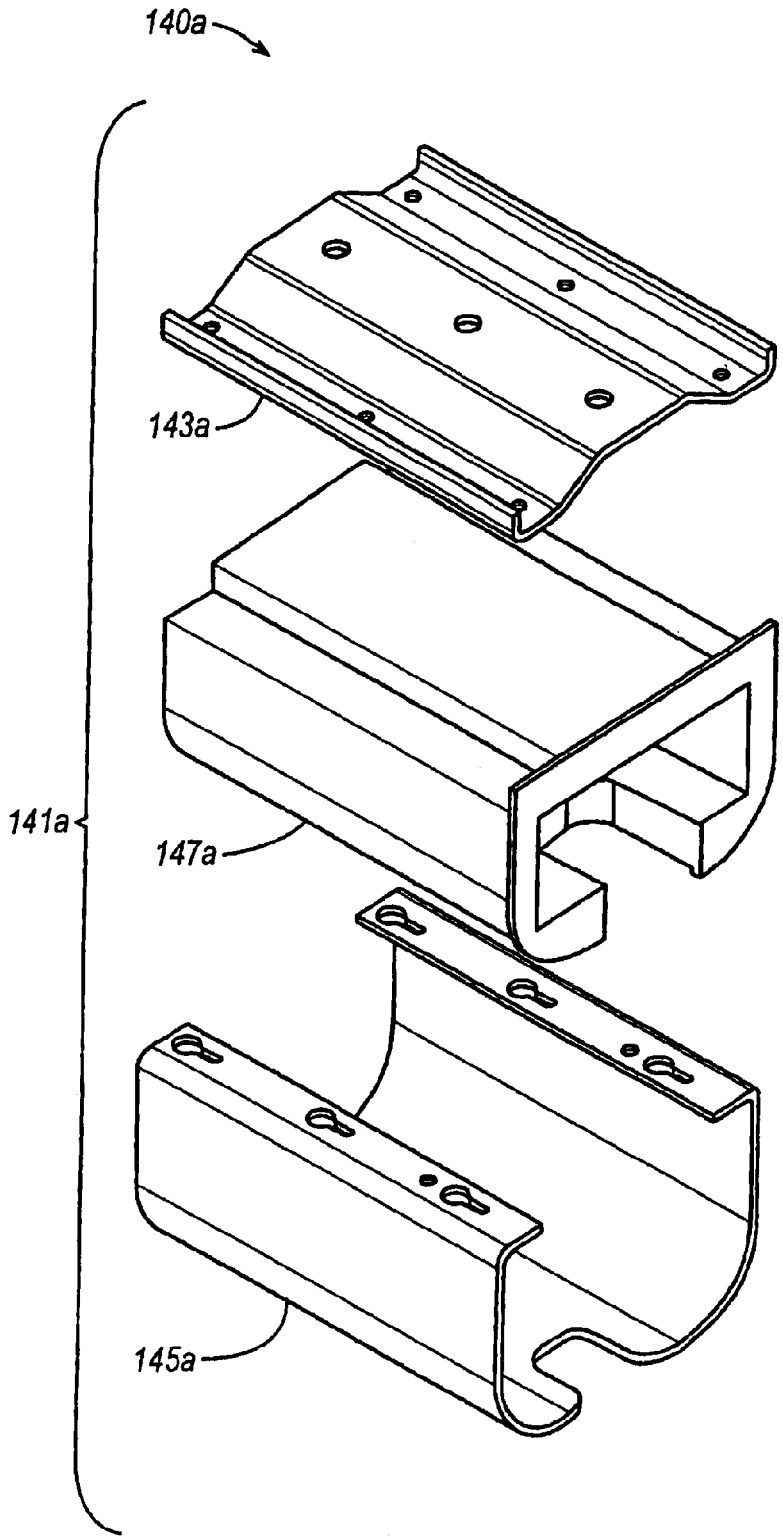
FIG. 6B is an exploded perspective view of the components of the recharging/docking station of FIG. 6A.

FIGS. 6A and 6B depict another form of the recharging/docking station 140*a*. In this form, the base 141*a* of the recharging/docking station 140*a* comprises a mounting bracket 143*a*, an outer sleeve 145*a*, and an inner sleeve 147*a* The mounting bracket 143*a* can be mounted to a wall, inside a trunk, or elsewhere. The outer sleeve 145*a* connects to the mounting bracket 143*a* and, together with the mounting bracket 143*a*, forms an opening. The inner sleeve 147*a* fits in the opening and has a recess 142*a* for receiving the holster 10. The geometry of the inside of the inner sleeve 147*a* is selected for the particular holster 10 it is to be used with, so that the same mounting bracket 143*a* and outer sleeve 145*a* can be used with different inner sleeves and holsters for different firearms.

Figure 7:
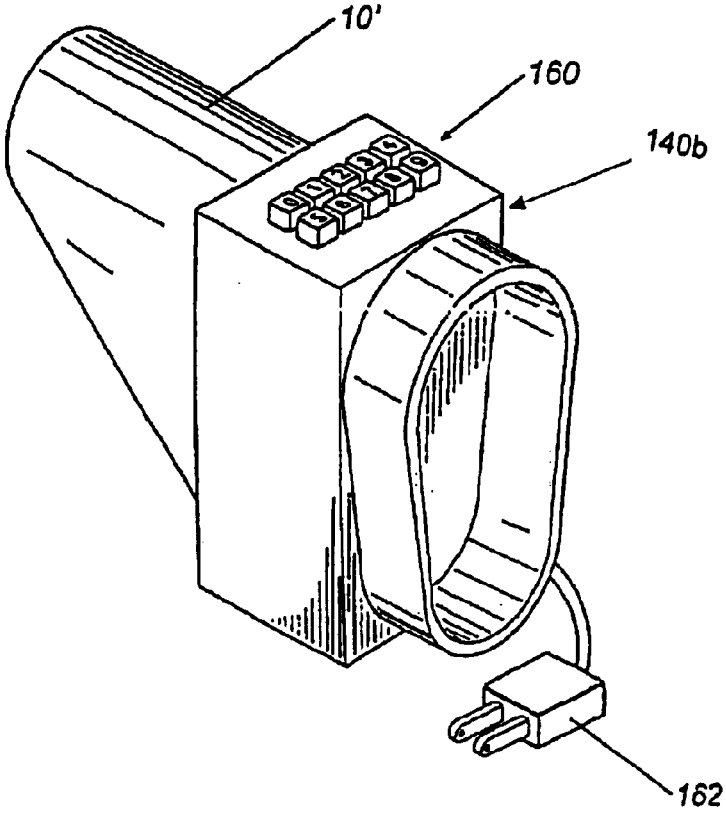
FIG. 7 is a perspective view of a safety holster and another preferred form of the recharging/docking station.

FIG. 7 depicts another form of the recharging/docking station 140*b* with a keypad 160 or other releasable locking means and a power cord and plug 162 for connection to an external power source, for use in securing the holster in an automobile trunk, a cabinets or another location.

FIGS. 5–9 depict additional preferred embodiments and features of the holster and associated components of the present invention. For example, the holster 10 of FIG. 5 includes an energy absorbing errant discharge pad 126 beneath the spring 120 and lift surface 122 for absorbing the impact of a round of ammunition accidentally discharged within the holster and thereby preventing injury to the wearer. The discharge pad 122 can be made of a conventional ballistic material such as KEVLAR, LEXAN, KYDEX, BALLISTICA PLEXIGLAS, or the like. Also, the pad 122 can be mounted onto the spring lift mechanism 119 for increased energy absorption.

The present invention further encompasses a holster configured to prevent unauthorized removal of an ammunition clip installed in a firearm secured in the holster. For example, as seen with reference to FIG. 9, the shell 24 of the holster defines a chamber for receiving at least a portion of the firearm 30. The top of the shell 24 defines a top opening bounded by a forward portion and a rear portion, for providing passage of the firearm 30 into the chamber. The rear portion preferably includes a lip 254 projecting generally upwardly beyond the top of the holster. When a firearm having an ammunition clip housed in its grip is contained in the holster 10, the extension of the lip blocks retraction of the clip and thereby restricts unauthorized removal of an ammunition clip from a firearm retained within said holster. The configuration of holster 10 to include the lip 254 for preventing unauthorized removal of an ammunition clip installed in a firearm can be provided separately from, or in combination with the identification means.

Figure 8:
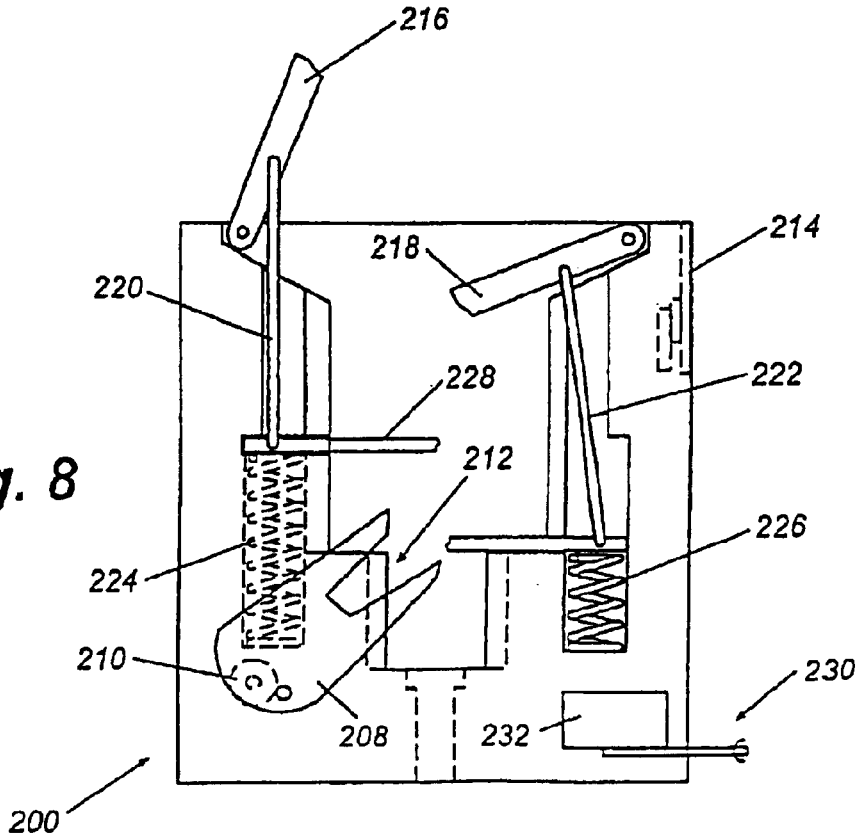
FIG. 8 is a front cutaway view of a safety housing for a rifle or other long gun according to a preferred form of the present invention.
Figure 8A:
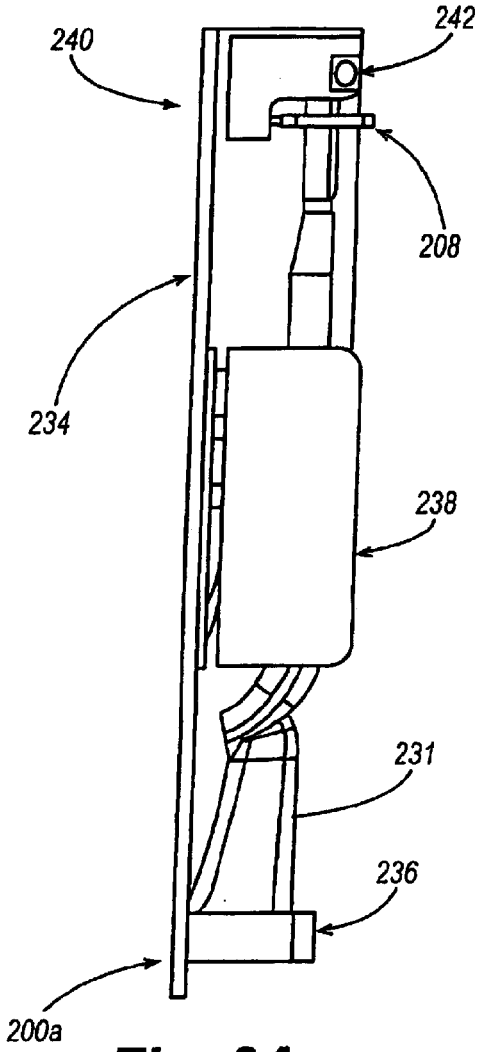
FIG. 8A is a side view showing a safety housing according to another preferred form of the present invention for use with a rifle, shotgun, or other long gun.
Figure 8B:
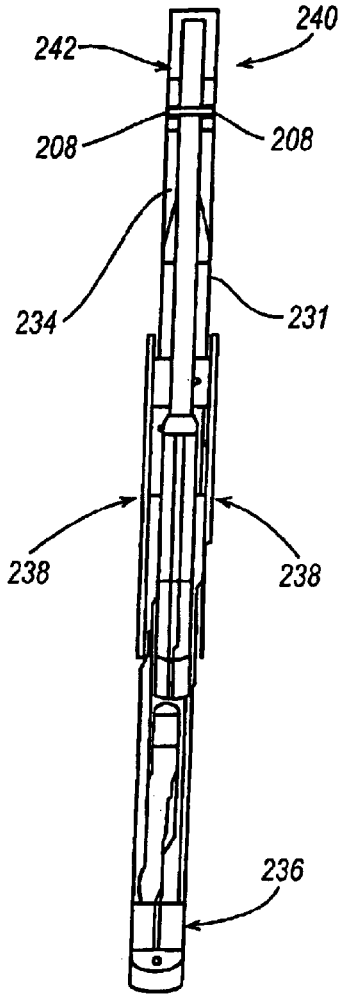
FIG. 8B is a front view of the safety housing of FIG. 8A.
Figure 8C:
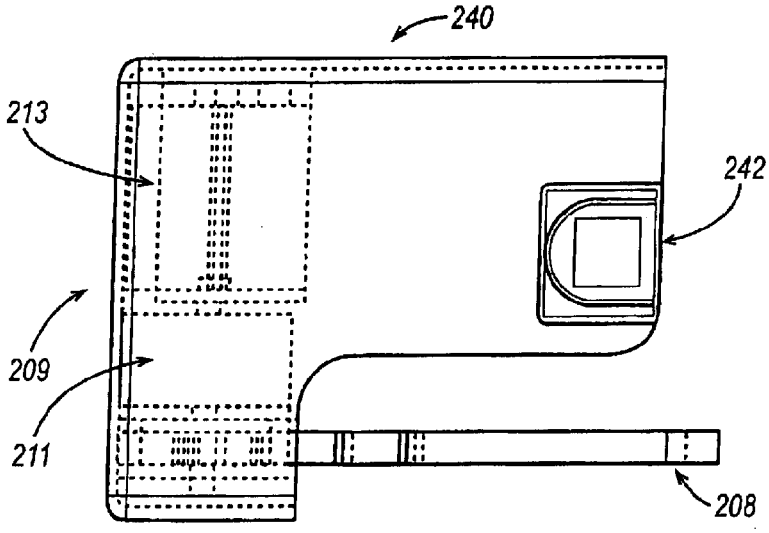
FIG. 8C is a side view of the securing mechanism used with the safety housing of FIG. 8A.
Figure 8D:
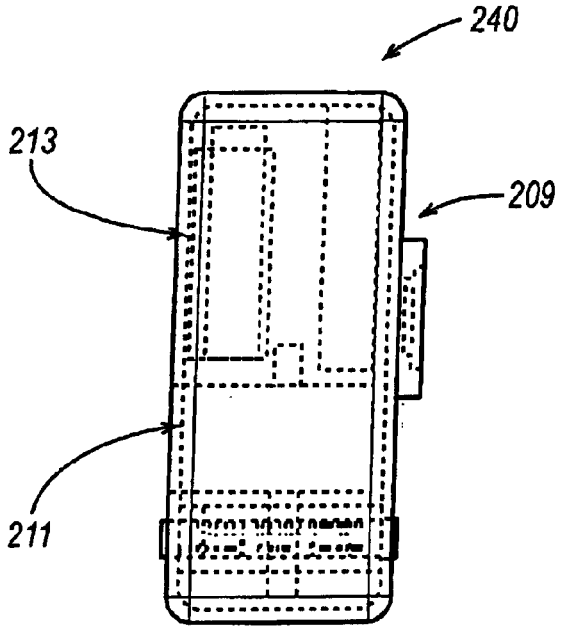
FIG. 8D is an end view of the securing mechanism of FIG. 8C.
Figure 8E:
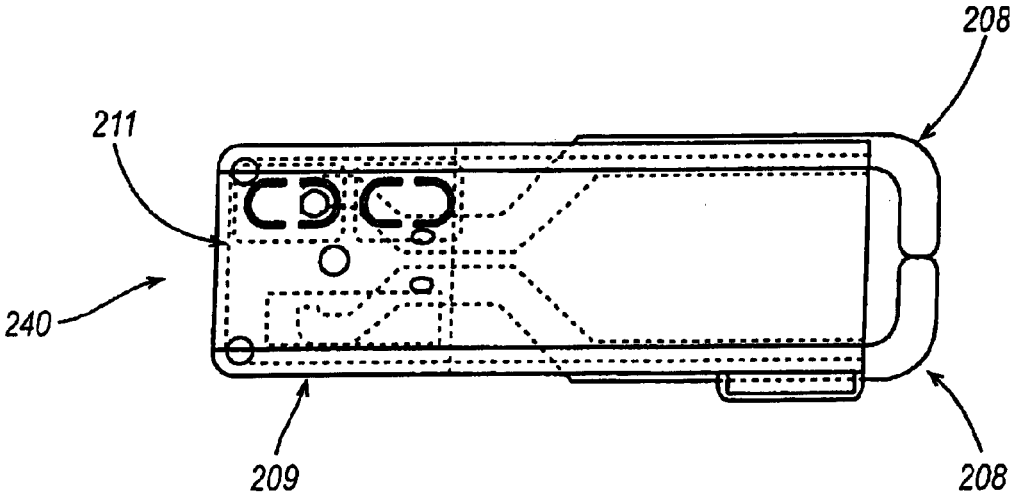
FIG. 8E is a plan view of the securing mechanism of FIG. 8C.

FIG. 8 shows an end view of another firearm safety housing of the present invention, comprising a sleeve type holster 200 for securing a rifle, shotgun or other long gun. A pivotal disc or other form of retaining member 208 (such as those described herein) engages the firearm, such as by receiving the trigger guard of the firearm within the notch 212, or as otherwise described herein. A solenoid 210 or other drive means is preferably provided to actuate the locking means in a substantially similar manner as described above. One or more cover plates 216,218 are preferably hingedly mounted over the channel or opening which receives at least the trigger guard portion of the firearm. The cover plates 216, 218 are preferably joined by links 220, 222 to a push-plate 228, and biased by one or more springs 224, 226 or other biasing means. The firearm is aligned with the axis of its barrel perpendicular to the plane of FIG. 8, with the trigger guard generally aligned with the disc 208. The firearm is then deposited downwardly through the top opening of the holster, and the trigger guard or other portion is engaged within the notch 212, causing the disc 208 to pivot from its first position to its second position. The locking means is actuated to lock the disc 208 in the second position to prevent removal of the firearm.

To access the firearm, an authorized user scans his or her fingerprint into the fingerprint sensor 214, and upon recognition of an authorized user, the processor signals the locking means to release, permitting the disc 208 to pivot from its second position to its first position, and allowing removal of the firearm from the holster 200. A battery 232 and means 230 for connection to an external power source are preferably provided in similar fashion to that described above. Of course, other biometric identification devices can be used.

FIGS. 8A–8E show another form of the housing 200*a* for securing a rifle, shotgun or other long gun. In this form, the housing 200*a* is a gun rack with a spine 234, an end cap 236, cover plates 238, and a securing mechanism 240. The end cap 236, cover plates 238, and securing mechanism 240 are mounted to the spine 234. The end cap 236 supports the butt end of the firearm and the cover plates 238 cover and block access to the firearm trigger, magazine, breech, bolt, pump-slide, or other firing and/or loading components. The spine 234 can be provided by a bracket, plate, bar, or other structure, the end cap 236 can be provided by a slab, block, or other structure with or without a recessed portion for receiving the long-gun butt, and the cover plates 238 can be provided by a two or another number of parallel plates or other structures.

The securing mechanism 240 (see FIGS. 8C–8E) has at least one retaining member 208, a lock mechanism 209 with an actuator 211 or other drive means and batteries 213 or another power supply, and a biometric identification means 242 such as a fingerprint sensor. These components can be similar to any of those of the embodiments described herein or can be provided by other components. For example, the retainers 208 can be provided by the pliers-type retainers shown in FIGS. 14–17. The retainers 208 engage the firearm such as by receiving the barrel of the firearm. When an authorized user scans his fingerprint, the retainers 208 are operated to release the gun barrel so that the gun can be removed from the safety housing 200*a*.

Preferably, the spine 234 is perforated and the end cap 236 and the cover plates 238 are mounted to the spine by fasteners such as bolts, screws, or tabs. The fasteners are receivable in the perforations so that the end cap 236 and the cover plates 238 can be configured in different positions along the spine. But when the firearm 231 is secured in the housing 200*a*, the fasteners cannot be accessed. Because the end cap 236 and cover plates 238 are adjustable on the spine 234 and the retainer 208 engages the firearm barrel, the housing 200*a* can be easily configured for use with different long guns.

These long gun housings 200 and 200*a* can be installed on a wall in a closet or cabinet for home use, in a trunk of a vehicle, in a SWAT van or police car passenger compartment, or elsewhere. Also, these housings can be installed in a vertical or horizontal orientation, as may be desired. Further, although the long gun housings described herein are shown for use with a single firearm, it will be understood that multiple securing mechanisms and other components can be arranged in parallel to accommodate multiple long guns in a single housing.

Additionally, the errant discharge chamber can be adapted for use with the rifle housing by, for example, attaching extension plates, tubes, or bars to the sides of the locking system and mounting the errant discharge chamber at the end. Another way to do this would be to extend the forward portion of the locking station using a channel configured to fit around the long gun barrel, similar to a piece of channel iron with the 'U' facing up or out. The long gun user would then slip the barrel into the errant discharge chamber and then lay the gun into the channel where the locking device would then engage the barrel, firing chamber, trigger guard, etc.

Figure 9:
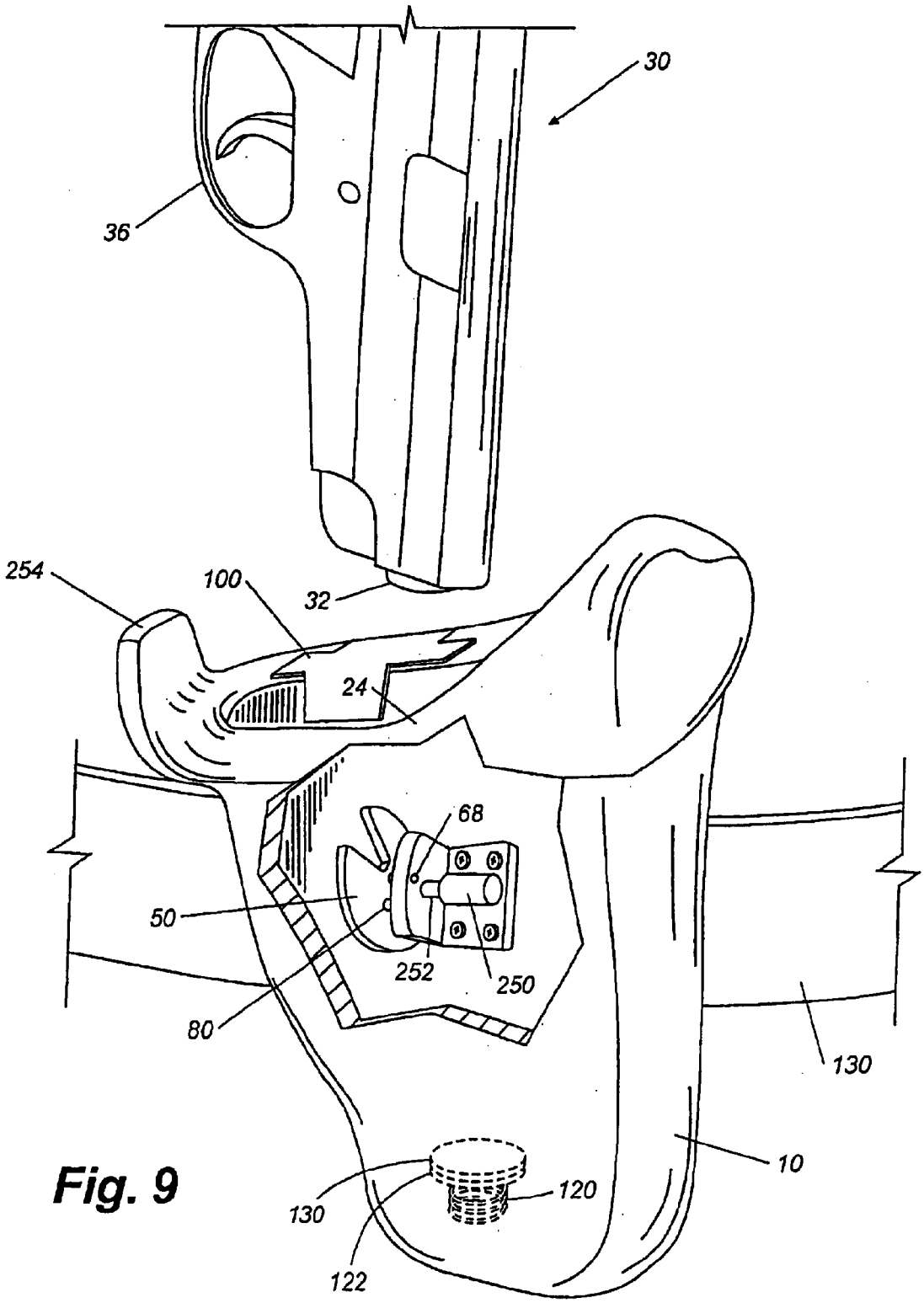
FIG. 9 is a perspective view, in partial cutaway, showing a safety holster according to another preferred form of the present invention.
Figure 13:
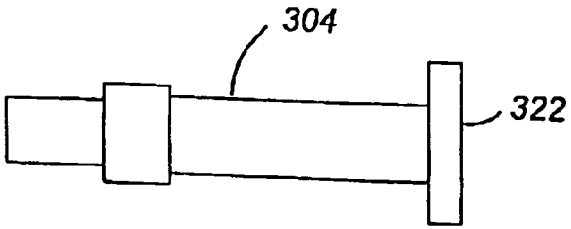
FIG. 13 is a side view of a plunger of the alternative lift mechanism of FIG. 10.
Figure 11:
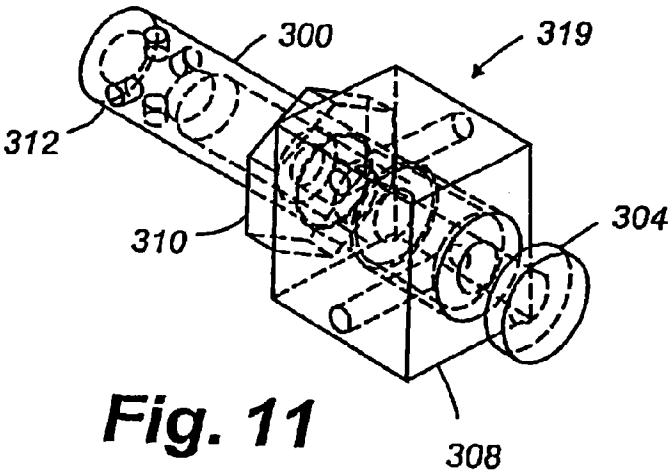
FIG. 11 is a perspective view of the alternative lift mechanism of FIG. 10.
Figure 12:
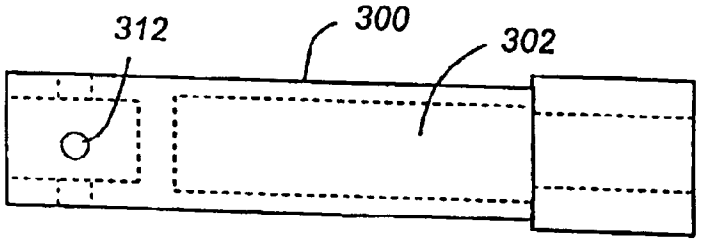
FIG. 12 is a side view of a housing of the alternative lift mechanism of FIG. 10.
Figure 10:
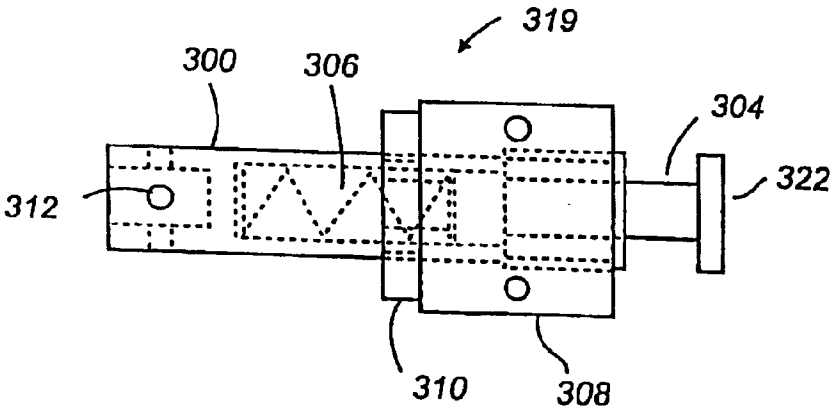
FIG. 10 is a side view of an alternative lift mechanism of the present invention.

FIG. 9 shows a holster 10 that is substantially similar to the holster described above with reference to FIGS. 1–4, but having a solenoid 250 in place of the servomotor 84. The solenoid preferably advances and retracts a shaft 252 into and out of engagement with the hole 80, in response to signals received from the processor (unshown), to lock the disk 50 in its second position to prevent removal of the firearm 30 from the holster 10.

Referring further to FIG. 9, the present invention optionally further comprises a disabling mechanism that renders the firearm unusable if an unauthorized user tampers with the holster and/or the docking station in an attempt to access the firearm. For example, a strip of magnesium 130 can be embedded in the holster and/or the docking station, preferably adjacent the firearm muzzle (as shown), the trigger, or the open end of the holster, or on the entire inner surface of the holster to encase the gun, or at another point on the firearm. The strip of magnesium is ignited upon sensing attempted tampering by an unauthorized user, thereby rendering the firearm unusable. Alternatively or additionally, a strip or seam of liquid, semi-liquid, powder or combination thereof, of quick or instantaneously setting epoxy, liquid metal, or other similar compound can be embedded in the holster and/or docking station for release upon sensing attempted tampering by an unauthorized user, thereby rendering the firearm unusable. Alternatively or additionally, the identification means and/or logic chip can be configured to disable the holster and/or the docking station to prevent removal of the firearm upon sensing attempted tampering. The user would then have to return the holster to the manufacturer or an authorized service provider to reset the unit and return it to normal operation. Alternatively or additionally, if a removable fingerprint sensor card or chip is provided, the identification and/or logic chips can be encrypted to accept signals only from the sensor card or chip of one or more authorized users, whereby in the event that a "foreign" card or chip is installed, the holster and/or docking station will disable until reactivated by the authorized user or an authorized servicer.

The tamper fail-safe system can include one or more simple star bridges, also known as a torque stress sensors, similar to those used in robots and remote control systems. For example, sensors produced by US Robotics can be suitably employed. The sensors can be attached to the holster by epoxy or another known attachment means for sensing mechanical tampering with the safety holster. Each sensor is attached to the holster shell at a point that might be affected by tampering with the gun or the holster shell, such as the retaining member, the mounting plate, the locking pin, the solenoid or servo, and so forth. When any of the sensors detects stress or pressure, it sends a digital signal to the chip set. Additionally or alternatively, the system can be activated by attempting to use unauthorized software, electronics, or by attempting to decipher the encryption used to activate the safety device. The chip set then shuts down the biometric recognition device/s and powers up a small capacitor. The capacitor would be in line at all times so the additional power needed to create the necessary amperage to fire the thermite (or other explosive material) strip or release the epoxy would be minimal. Upon detection of continued tampering, the capacitor would discharge firing the fail-safe disabling mechanism, thereby rendering the firearm useless. The entire function could be contained inside the safety holster so that no one is injured when the thermite ignites when the fail-safe discharges.

FIGS. 10–13 show an alternative lift mechanism 319 that fictions similar to the lift mechanism described above with reference to FIGS. 2 and 3. In this embodiment, the lift mechanism 319 has a housing 300 with an opening 302 that receives a plunger 304. A spring 306 biases the plunger 304 to extend from the housing 300. A base 308 can be provided for mounting the lift mechanism 319 to the holster, as desired. A nut 310 can be provided for adjusting the travel of the plunger 304 relative to the housing 300 for the particular firearm to be secured in and withdrawn from the holster. Also, adjustment tool ports 312 can be provided in the housing 300, as desired. A padded lift surface 322 can also be provided on or adjacent to an end of the plunger, with padding sufficient to prevent damaging the barrel of the firearm, with a shock-absorbent errant discharge pad sufficient to substantially absorb the impact of a bullet or another projectile fired from the firearm, or with another padding as desired. This lift mechanism 319 is shown in use with the holster 10 and firearm 30 in FIGS. 4K and 4L.

Figure 16:
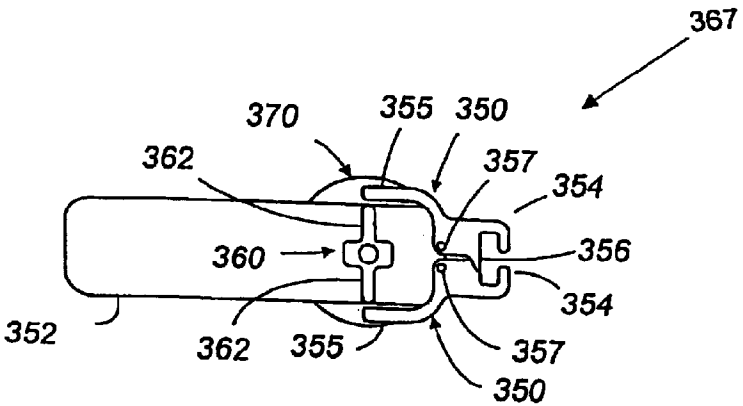
FIG. 16 is a top plan view of the alternative retainer, lock, and actuator mechanisms of FIG. 14 shown in a second locked position
Figure 17:
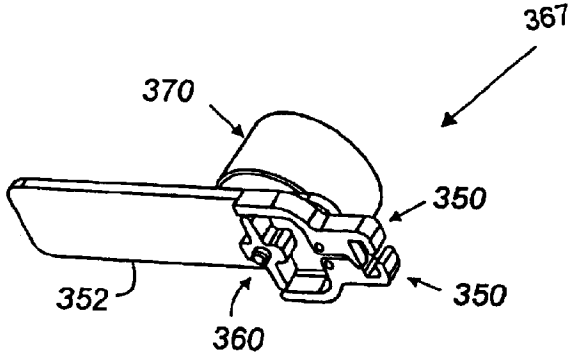
FIG. 17 is a perspective view of the alternative retainer, lock, and actuator mechanisms of FIG. 16.

FIGS. 14–20 show another exemplary embodiment of the present invention, with the securing mechanism 367 having two (or another number of) retaining members 350 pivotally coupled to a base member 352. The base member 352 can be provided by a plate, arm, block, bar, or the like, formed integrally with or separately from the holster. Each retaining member 350 has a catch arm 354*b* with a catch surface 355*b* that engages a portion of the firearm 330, and a lock arm 356. The retaining members 350 pivot about one, two, or another number of pivot points 357 such as pins, rivets, screws, or the like. For example, the retaining members 350 can be arranged in a pliers-type configuration that cooperate to retain a portion of the firearm. One or both of the retaining members 350 can have an actuating arm 354*a* that extends therefrom with an engagement surface 355*a* on the actuating arm configured such that, when the firearm 330 is inserted into the holster, the actuating arm engagement surface is contacted by the trigger guard 336 or another portion of the firearm to cause the retaining member 350 to pivot from a first unlocked position (FIGS. 14 and 15) to a second locked position (FIGS. 16 and 17).

A rotary lock member 360 has two (or another number of) lock arms 362 that, when the lock member is positioned to a first unlocked position, permit the retaining members 350 to pivot to the first unlocked position. However, when the lock member 360 is pivoted to a second locked position, the lock arms 362 of the lock member 360 abut and engage the lock arms 356 of the retaining members 350 to secure the retaining members 350 in the second locked position. The lock member 360 can be rotationally coupled to the base member 352 by a pin, rivet, screw, or the like. Alternatively, the lock arms 362 can be provided by one or more cams, ramps, or other structures extending from the lock member 360, or by one or more notches or other structure recessed into the lock member.

An actuator 370 is provided to operate the lock member 360. For example, the actuator 370 can be provided by a rotary solenoid. Alternatively, the actuator can be provided by a linear solenoid, a servomotor, a pneumatic or hydraulic actuator, or another drive mechanism known in the art. The rotary solenoid can be provided with a spring configured so that, when the solenoid is de-energized, the spring rotates the lock member 360 to the first unlocked position. Accordingly, the solenoid can be selected with a spring factor that is sufficiently strong to pivot the lock arms 362 of the lock member 360 to the first unlocked position when the solenoid is not energized. However, the solenoid is also selected go that, when energized, it rotates the lock member 360 with sufficient force to cause the lock arms 362 thereof to contact the retaining member lock arms 356 and pivot the retaining member catch arms 354*b* into sufficient proximity with the firearm to retain the firearm within the holster. Alternatively, the retaining members, lock members, and actuator can be configured so that, when the solenoid is de-energized, the lock member and the retaining members are biased to the second locked position, and when the solenoid is energized, it rotates the lock member and the retaining members to the first unlocked position. Also, the power source 310 is selected to provide the needed power to the solenoid or other actuator 370.

In this arrangement, the rotary actuator is generally unaffected by shocks from hitting or dropping the holster in an effort to unlock the firearm from the holster. Also, the locking member 360 can be dimensioned relatively small so that it takes up minimal space and has minimal weight. Additionally, the locking member, retaining member, and actuator can be readily produced as modular units for efficiency and flexibility in manufacture and sale. Furthermore, the retaining members can have a protective layer made of a plastic or other material that prevents scratching or otherwise damaging the trigger guard.

Figure 20:
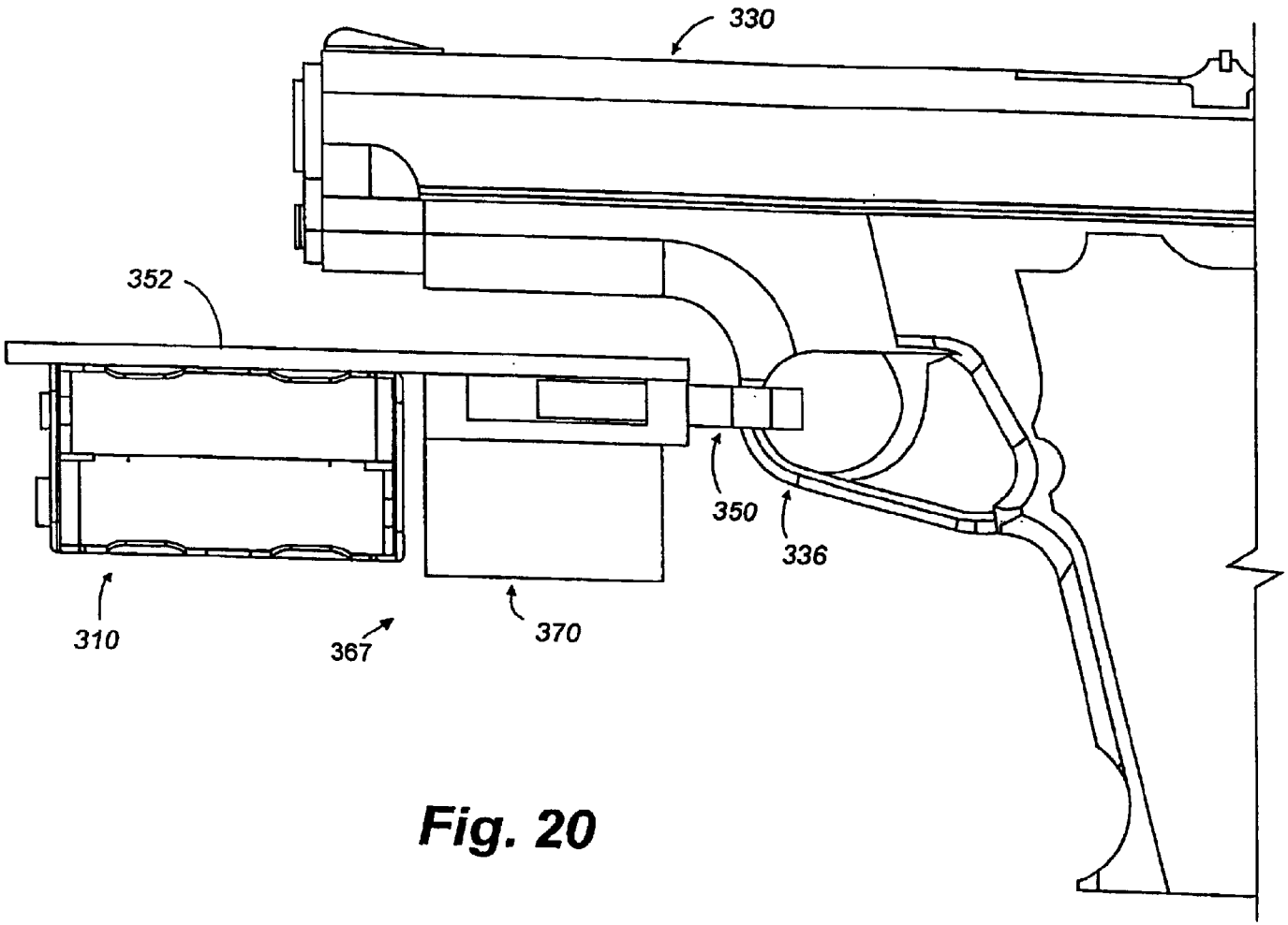
FIG. 20 is a side view of the alternative retainer, lock, and actuator mechanisms of FIG. 19.
Figure 20A:
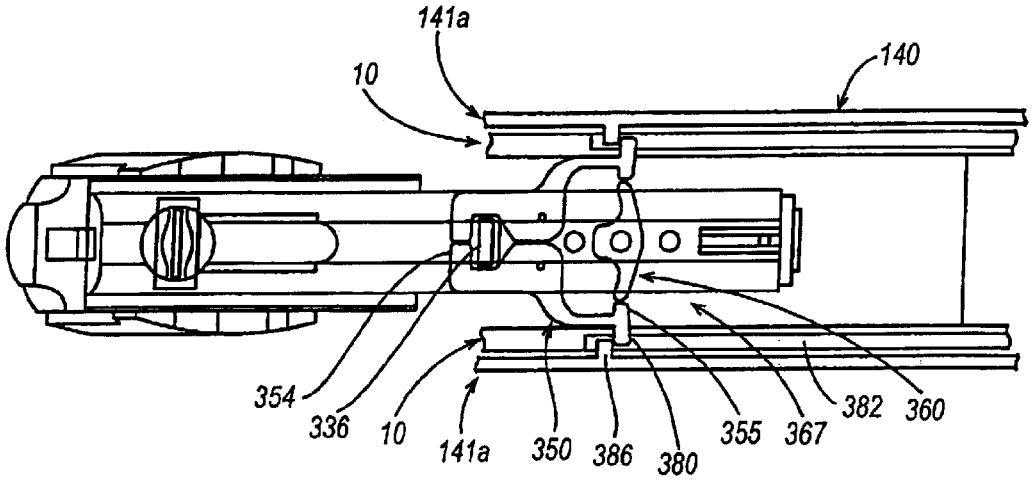
FIG. 20A is a plan view of another alternative retainer, lock, and actuator mechanism and a cross-sectional portion of a holster and a recharging/docking station, showing an interlock mechanism for interlocking the firearm, the holster, and the recharging/docking station.
Figure 20B:
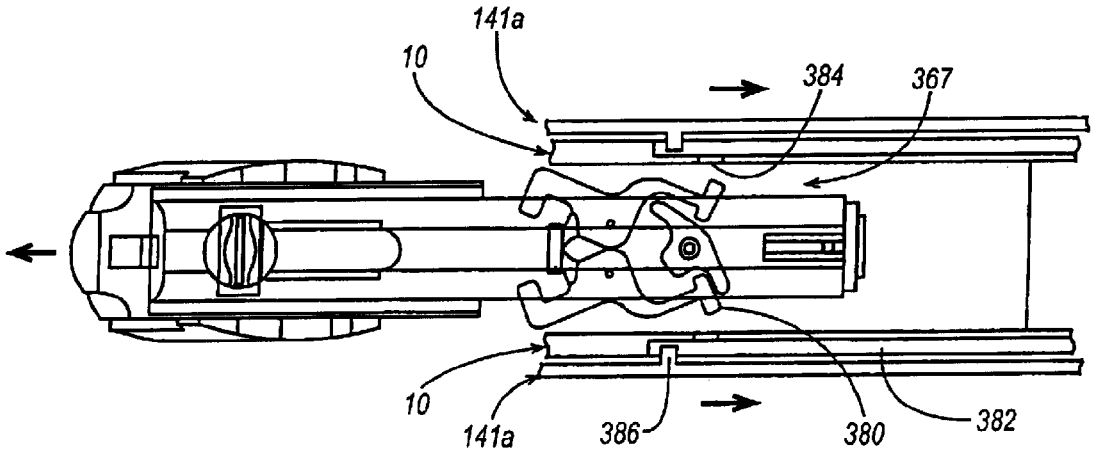
FIG. 20B is a plan view of the components of FIG. 20A, showing the interlock mechanism releasing the firearm and the holster from the recharging/docking station.
Figure 22:
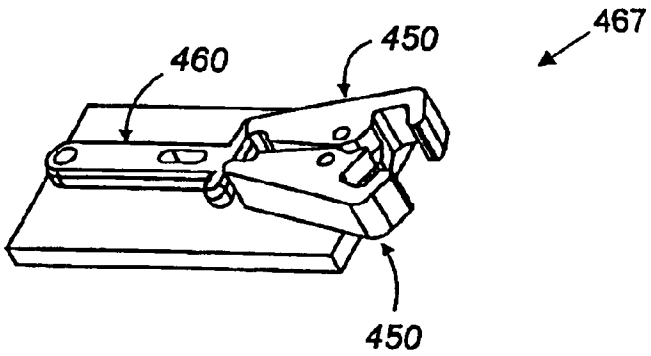
FIG. 22 is a perspective view of the alternative retainer, lock, and actuator mechanisms of FIG. 21.

FIGS. 20A and 20B depict another embodiment with an interlock mechanism that locks the firearm in the holster 10 and at the same time locks the holster in the recharging/docking station 140*a* or in a gun safe or other safety housing. In this form, one or more of the retaining members 350 has an interlock arm 380 extending from it so that the interlock arm protrudes from the holster as shown in FIG. 20A when the securing mechanism 367 is in the second locked position of FIGS. 16 and 17. For example, one or two interlock arms 380 can be provided, with each interlock arm 380 positioned on the retaining member 350 opposite one of the lock arms 355. Additionally, the holster can have an interlock groove 382 (see also FIG. 28) along one or both sides, each groove including an interlock opening 384 through the holster that is aligned with and receives through it one of the interlock arms 380. The interlock arms 380 engage interlock tabs 386 extending inwardly from the recharging/docking station 140*a*, gun safe, or other safety housing. Thus, the interlock tabs 386 are positioned on the inside of the recharging/docking station 140*a* so that they align with and are received in the interlock grooves 382. This also helps smoothly guide the holster in and out of the recharging/docking station 140*a*. As can be seen in FIG. 20A, then, when the securing mechanism 367 is in the second locked position, the firearm is locked in the holster 10 by the engagement arms 354 constraining the trigger guard 336 and at the same time the holster is locked in the recharging/docking station 140*a* by the interlock arms 380 protruding into the interlock grooves 382 and engaging the interlock tabs 386.

Figure 14:
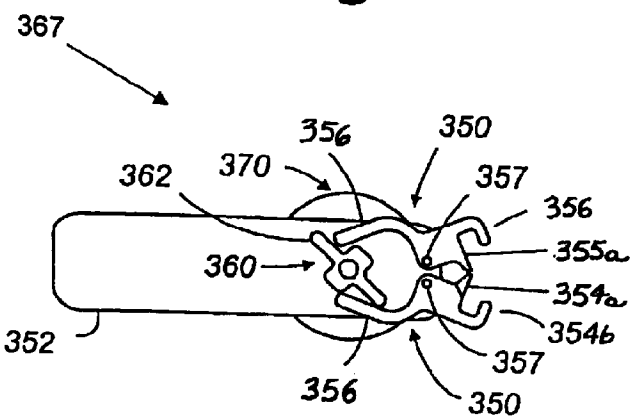
FIG. 14 is a top plan view of an alternative retainer, lock, and actuator mechanisms of the present invention shown in a first unlocked position.
Figure 15:
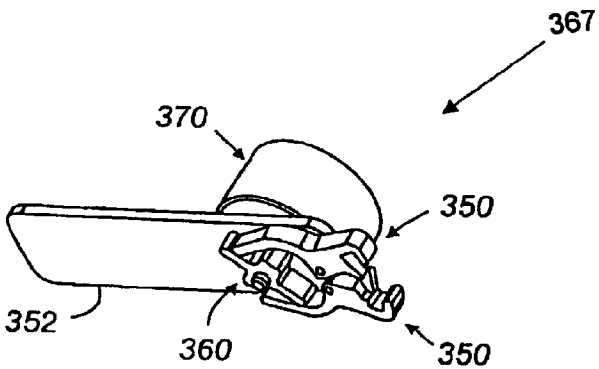
FIG. 15 is a perspective view of the alternative retainer, lock, and actuator mechanisms of FIG. 14.
Figure 19:
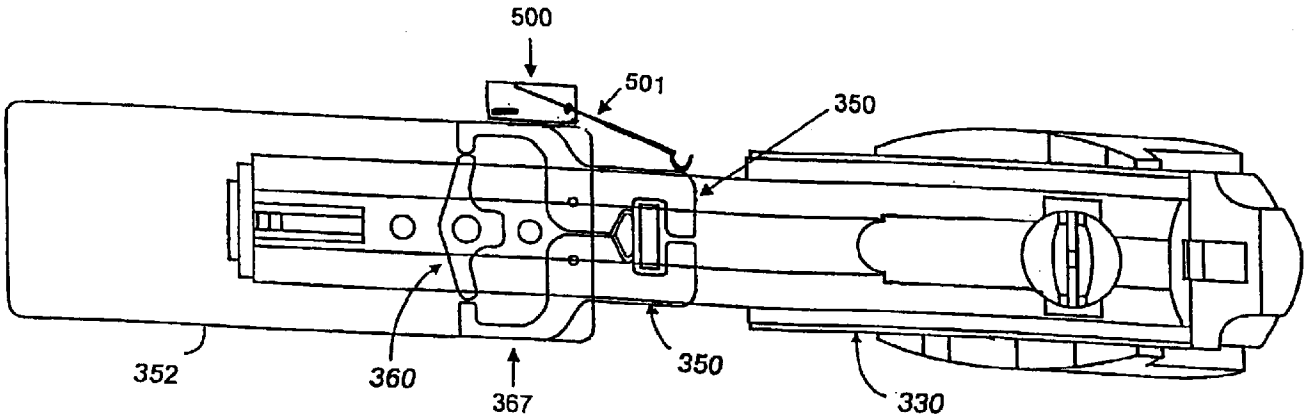
FIG. 19 is a top plan view of the alternative retainer, lock, and actuator mechanisms of FIGS. 16 and 17 in use with the housing and firearm in the second locked position.
Figure 18:
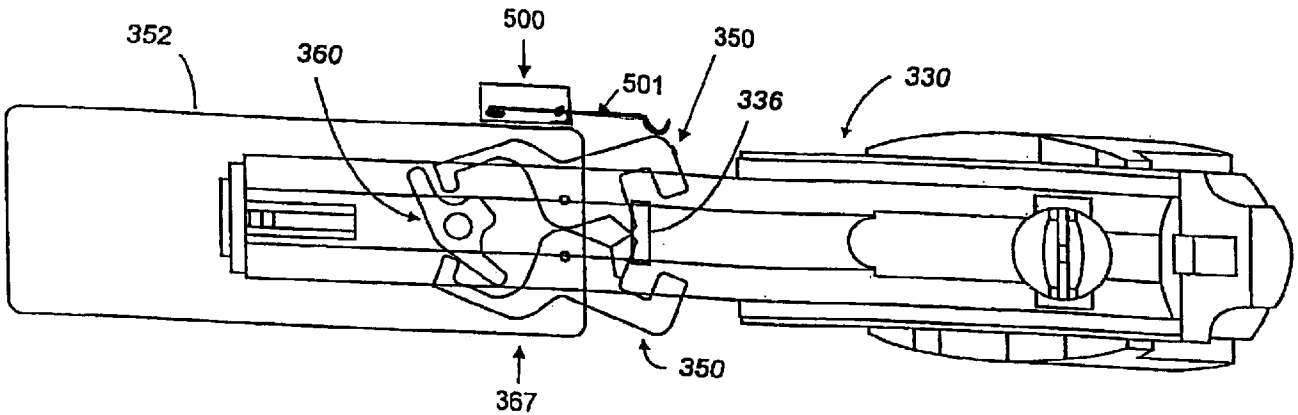
FIG. 18 is a top plan view of the alternative retainer, lock, and actuator mechanisms of FIGS. 14 and 15 in use with the housing and firearm in the first unlocked position.

As shown in FIG. 20B, when the locking mechanism is operated to release the retaining members 350 to move to the first unlocked position of FIGS. 14 and 15, the interlock arms 380 are withdrawn from the interlock grooves 382 back into the holster 10, so they do not impede the interlock tabs 386 from sliding along the grooves. Then the firearm can be withdrawn from the holster 10 and/or the holster and firearm can together be withdrawn from the recharging/docking station 140*a*.

It will be understood that the securing mechanisms described herein for use with safety housings for firearms can be adapted for other applications to lock a structure in place and to selectively release it for use. Such other applications include but are not limited to locking and releasing bicycles, vehicle steering wheels, tools, electronics, luggage, and cabinets for money, jewelry, and/or other valuables.

Figure 24:
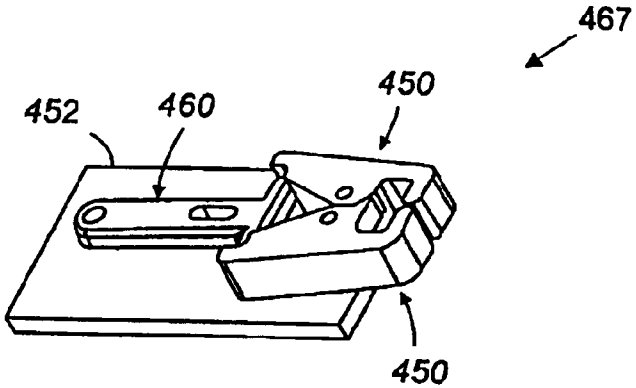
FIG. 24 is a perspective view of the alternative retainer, lock, and actuator mechanisms of FIG. 23.
Figure 21:
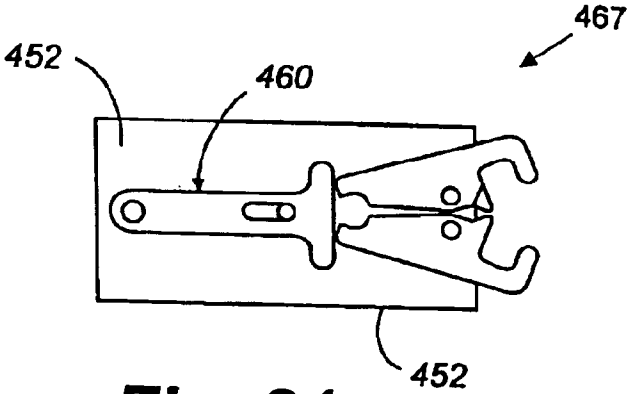
FIG. 21 is a top plan view of alternative retainer, lock, and actuator mechanisms of the present invention shown in a first unlocked position.
Figure 23:
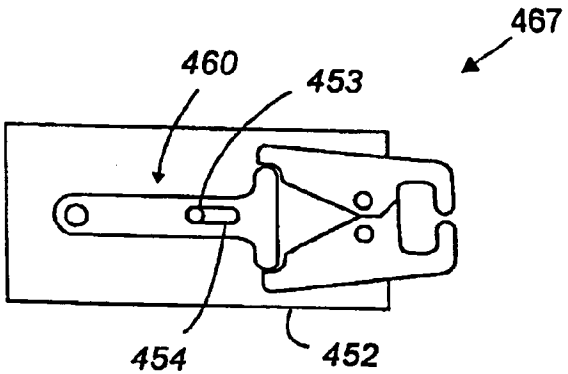
FIG. 23 is a top plan view of the alternative retainer, lock, and actuator mechanisms of FIG. 21 shown in a second unlocked position

FIGS. 21–24 show an alternative embodiment of the securing mechanism 467 that is similar to the embodiment of FIGS. 14–20, with the retaining members 450 and lock member 460 adapted for use with a linear actuator such as a linear solenoid. In this form, the lock member 460 is linearly coupled to the base member 452 by, for example, a pin 453 that extends through a slot 454 in the base member 452. Of course, the pin 453 can be provided by a bolt, screw, rivet, tab, bar, or the like. Alternatively, the lock member 460 can be guided by an exterior surface of the base member, or the base member can have a protrusion that guides the lock member, to permit the lock member to move between a first unlocked position (FIGS. 21 and 22) and a second locked position (FIGS. 23 and 24).

Figure 25:
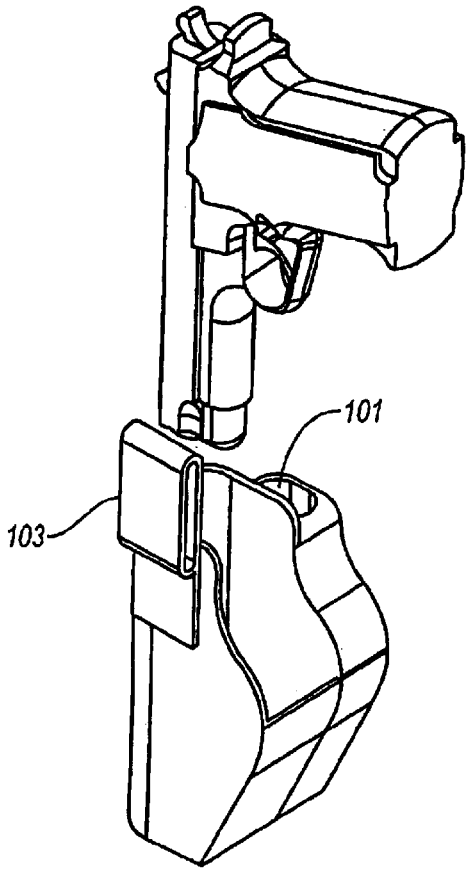
FIG. 25 is a perspective view of another holster embodiment of the present invention, showing a finger guide recess for housing the fingerprint sensor.

FIG. 25 shows an alternative embodiment of the holster of the present invention with the fingerprint sensor (not shown) positioned in a guide recess 101 on the side of the holster opposite the belt loop 103. In this way, when the user inserts his forefinger in the guide recess 101, his finger end abuts the bottom of the recess and his finger pad is automatically positioned on the sensor.

Figure 26:
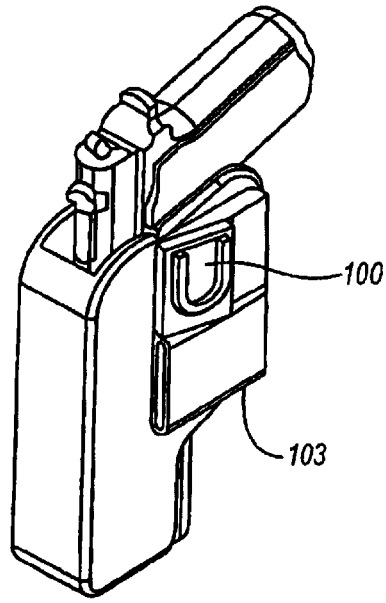
FIG. 26 is a perspective view of another holster, showing the fingerprint sensor positioned on the side of the holster.

FIG. 26 shows another embodiment with the fingerprint sensor 100 positioned on the side of the holster with the belt loop 103. In this way, the user's thumb can be ergonomically placed on the sensor.

Figure 27:
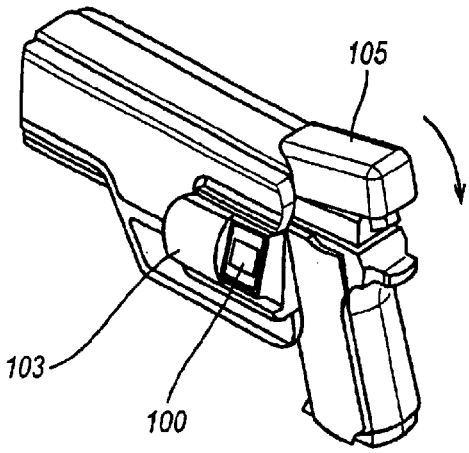
FIG. 27 is a perspective view of yet another holster, showing the fingerprint sensor and a slidable sensor cover protecting the sensor, as well as a pivotal hammer cover.
Figure 28:
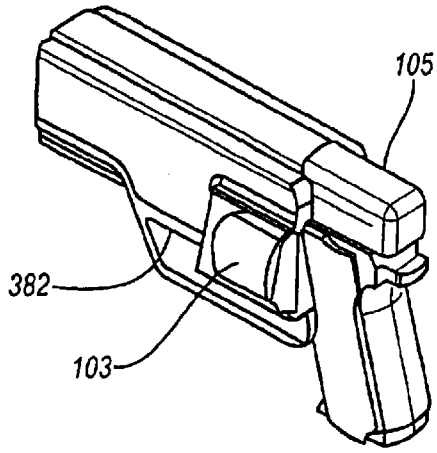
FIG. 28 is a perspective view of the holster of FIG. 27, showing the cover slid to access the fingerprint sensor and the hammer cover pivoted to a closed position.
Figure 29:
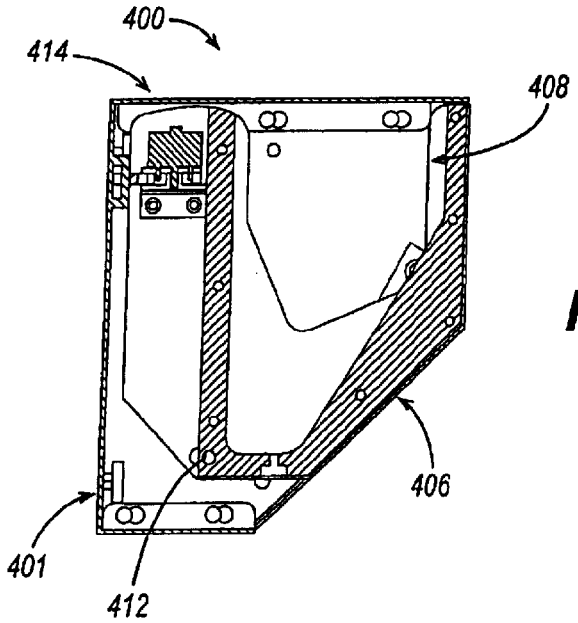
FIG. 29 is a side cross-sectional view of a gun safe embodiment of the present invention, showing a firearm carrier in a closed position in a base.
Figure 30:
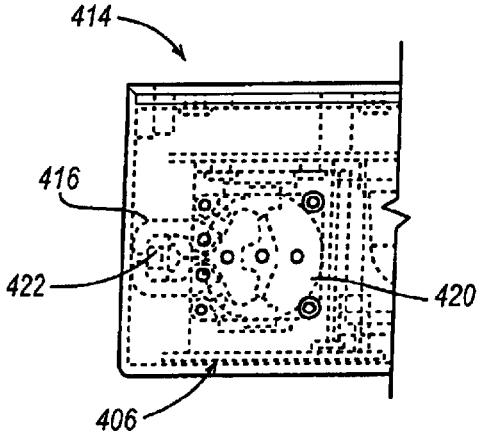
FIG. 30 is a plan view of a securing mechanism of the gun safe of FIG. 29.
Figure 31:
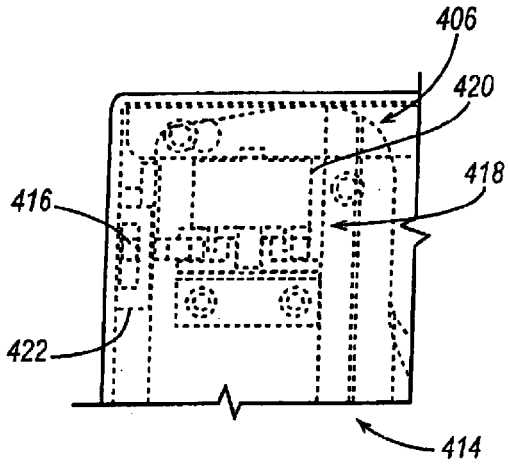
FIG. 31 is a side view of the securing mechanism of the gun safe of FIG. 29.
Figure 32:
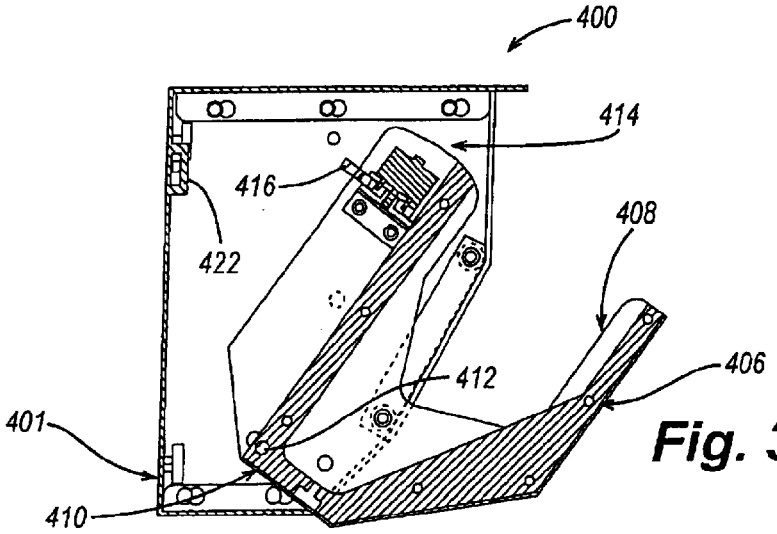
FIG. 32 is a side cross-sectional view of the gun safe of FIG. 29, showing the firearm carrier in an open position ready to receive a gun or gun and holster.
Figure 33:
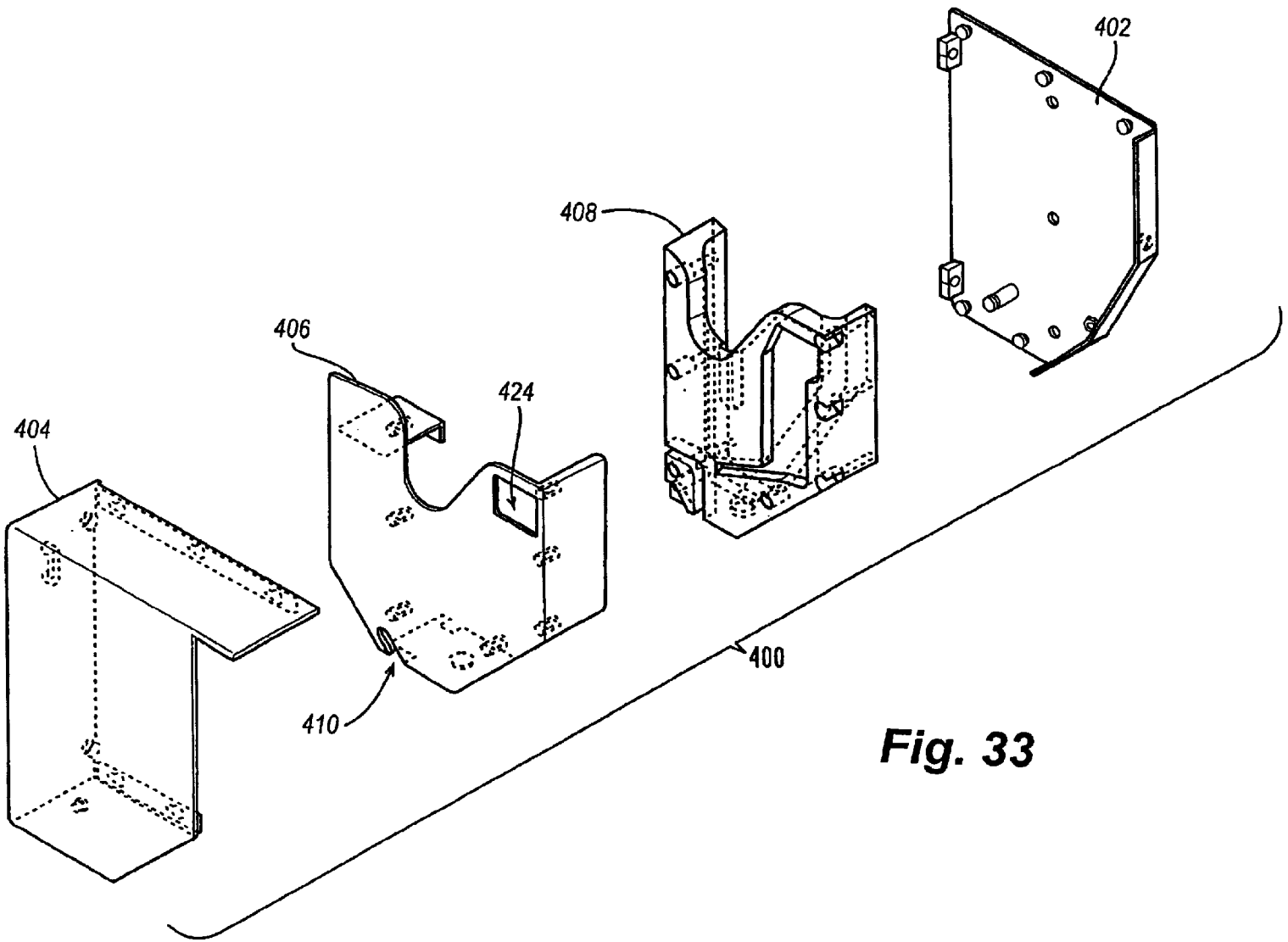
FIG. 33 is an exploded perspective view of the gun safe of FIG. 29.

FIGS. 27 and 28 show still another embodiment with the fingerprint sensor 100 positioned on the side of the holster and with a slidable sensor cover 103. For normal use, as shown in FIG. 27, the user can slide the cover 103 over the sensor 100, or a spring can be provided to bias the cover into position over the sensor. Then to withdraw the firearm, as shown in FIG. 28, the user can slide the cover 103 from over the sensor 100 in order to place his finger on the sensor.

Additionally, FIGS. 27 and 28 show a hammer guard 105 that is pivotally mounted to the holster for covering the hammer of the firearm. The hammer guard 105 has a catch member (not shown) extending from an inside wall of the hammer guard. When the firearm is inserted into the holster, the hammer or another part of the gun engages the catch member to pivot the guard though a closing motion (see FIG. 27) and to a closed position (see FIG. 28). When the firearm is locked in the holster, the engagement of the catch by the firearm prevents the hammer guard from being pivoted to the open position. In this way, those guns that can be fired by hammer action alone, without pulling the trigger, can be safely secured by the holster.

FIGS. 29–33 show another safety housing embodiment of the present invention, this one a base station in the form of a gun safe 400. The gun safe 400 has a base 401 and a pivotal carrier 406 for holding the firearm. The base 401 and carrier 406 are made of a structurally strong material such as a metal. The base 401 is formed by, for example, a mounting plate 402 and a cover 404. The mounting plate 402 mounts to a wall or other surface and the cover 404 attaches to the mounting plate. Alternatively, the base 401 can be provided as a unitary piece. It will be understood that the gun safe can be provided with the fail-safe disabling mechanism and/or with any of the other accessory components described herein.

The base 401 has an internal space that receives the pivotal carrier 406. The carrier 406 can be sized and shaped to hold a firearm or a holster for a firearm. Alternatively, a liner 408 can be inserted into the carrier for holding the firearm or a holster for the firearm. In this way, different liners 408 with different internal geometry can be used for different firearms and/or holsters, while the other components of the gun safe 400 remain the same. In any event, the carrier 406 and/or the liner 408 can have a portion made of a non-abrasive material such as plastic so as not to scratch the firearm.

The carrier 406 is pivotally coupled to the base 401. For example, the carrier 406 can have a slot 410 defined in an edge thereof that receives a pin 412 extending from the base 401. In this way, the carrier 406 can be lifted so that the pin 412 is transversely removed from the slot 410, then the carrier can be removed from the base 401. Alternatively, the carrier 406 can be pivotally mounted to the base 401 by other conventional couplings.

The carrier 406 pivots from a closed position (see FIG. 29) with the firearm safely inaccessible within the base 401 to an open position (see FIG. 32) permitting the firearm to be removed for use. The carrier 406 is secured in the base 401 in the closed position by a securing mechanism 414 having at least one retainer member 416 and a locking mechanism 418 with an actuator 420. T he retainers 416 engage a catch 422 on the base 401 and the locking mechanism 418 holds the retainers in place to secure the carrier 406 in the closed position. Because the base 401 and the carrier 406 lock together, instead of the retainers 406 engaging the gun, the geometry of the retainers is not dependent on the particular gun being stored.

To remove the firearm from the safe 400, the user authenticates himself as an authorized user by using a biometric identification means 424 such as a fingerprint sensor. The fingerprint sensor 424 is positioned on aside or end of the carrier 406 that protrudes from the base 401 when in the closed position. If the person is an authorized user, the sensor 424 is controlled to operate the actuator 420 of the locking mechanism 418 which moves the retainers 406 to release the catch 422. Because of the weight of the firearm on the carrier 406, the carrier then drops to the open position under the force of gravity. Additionally, or alternatively, a spring can be provided to assist in pivoting the carrier 406 open.

It will be understood that the securing mechanism 414 (including the retainers 406 and the actuator 420) and the biometric identification means 424 can be provided by any of the like-named components described herein. Because the gun safe 400 is mounted in place, however, it will be understood that the actuator can be suitably provided by a linear solenoid, as the benefits of a shock-proof rotary solenoid are mitigated. Also, the retainers 406 can include rollers mounted on their ends to reduce friction when they engage the catch 422 and/or the lock member when the carrier 406 is pivoted to the closed position.

Preferably, all the operational components are mounted to the carrier 406, including the securing mechanism 414, the fingerprint or other biometric sensor 424, the controller (not shown), and the power supply (not shown). Because the carrier 406 can be easily removed from the base 401 when in the open position (due to the pin and slot arrangement), the carrier can be taken to the user's home computer to reprogram the sensor 424 for the desired users or the carrier can be sent off for reprogramming or repair without having to remove the entire gun safe 400 from the wall.

The power supply can be provided by power cord for connection to conventional 120 volt AC house voltage with a DC converter, and with a backup 9 volt battery or other batteries in case an intruder cuts the home's power supply. Also, the controls can include a green or other color light for indicating normal status, a red, blinking, or other light or tone for indicating low battery level, and an override system with an auxiliary power jack and/or a backup key lock.

In another exemplary embodiment of the present invention, the fingerprint or other biometric sensor is pivotally mounted to the holster or a component of the holster and fixed in a locked second position, and a release arm of the retaining member is positioned generally adjacent the sensor. When the user positions one (or more) of his fingers on the sensor and the sensor positively identifies the user as an authorized user, then the controller releases the sensor to pivot. The user can then depress and pivot the sensor toward an unlocked first position. As the sensor pivots toward the unlocked first position, it contacts the release arm of the retaining member thereby causing the retaining member to retract and unlock the firearm for withdrawal from the holster. This embodiment is similar to the card key entry systems for doors commonly used in hotels.

Additionally, the invention can comprise a system wherein authorized users can connect the safety housing to personal communication devices such as radios, cell phones, handheld computers, etc. The securing mechanism may be provided with a sensor that communicates through the personal communication device whether the securing mechanism is in the locked or unlocked position. For example, referring back to FIGS. 18 and 19, the sensor can be provided buy a micro-switch 500 with a switch lever 501 that is engaged by one of the retainers 350, the lock member 360, the firearm, or another component of the housing. The switch 500 in the position of FIG. 19 indicates to the communication system that the firearm is locked in the housing, and the switch in the position of FIG. 18 indicates to the communication system that the user has withdrawn the firearm or at least unlocked the firearm in preparation for possible withdrawal. In this way, a police officer could link his or her holster to the communication system that he wears such that when the retaining member is moved to the open position permitting the firearm to be drawn, a signal is sent by the communication system to a police station or home office indicating that the officer has drawn his weapon. This might be of use when the officer wants to draw the weapon and remain quite and still alert his station that he might need help. Of course, the sensor or sensors may be suitably provided by contacts, pushbuttons, pressure switches, or other conventional devices.

Additionally, the safety holster could have signaling means for indicating a low battery, that the holster has been tampered with, that the device is now deactivated and must be returned to an authorized dealer for repair or reactivation, etc. If the fail-safe has been activated, the authorized user should be able to tell and either be able to deactivate it or take into some one authorized to deactivate it. If the fail-safe has fired and thereby destroyed the weapon, it should be apparent to the user.

A further signaling means that would be useful to law enforcement and the military, for example, would be an alert signal sent to the police station or military command from the holster when it has been disconnected from a radio alert system, and a global positioning system or the like to aid in locating the firearm, safety housing, and/or police officer if he is unable to communicate. The signaling means could comprise a set of contacts in the safety holster that would close a circuit to send the desired signal through the officer's radio unit.

The present invention further comprises a method of preventing unauthorized use of a firearm. According to preferred form, the method of the present invention comprises providing a holster substantially as described and depicted herein. The method preferably further comprises placing a firearm within the safety housing holster and engaging a retaining member portion of the housing with a cooperating portion of the firearm. In further preferred embodiments, the retaining member comprises a notched disk that rotates between a first position for receiving and releasing the trigger guard of a firearm and a second position for retaining the firearm in the housing, and the housing further comprises locking means to secure the retaining member in place to prevent unauthorized withdrawal of the firearm from the housing. A prospective user of the firearm scans his fingerprint or other biometric measure using a biometric sensor of the holster. A processor compares the scanned biometric information with stored fingerprint information of an authorized user of the firearm, and permits removal of the firearm from the holster only if the scanned biometric information matches that of the authorized user.

The safety housing of the present invention also enables a method allowing a purchaser to obtain a firearm, which is disabled from use pending completion of a background check. The firearm can be locked in the housing by the seller, and the fingerprint scanner and/or other biometric identification means removed or disabled to prevent removal of the firearm from the housing. Upon successful completion of the background check, the biometric scanner and/or other biometric identification means is replaced or enabled, allowing the purchaser to access and use the firearm. In further preferred embodiments, upon completion of a background check the state agency may forward the purchaser or an approved firearms dealer an indication of the successful clearance, along with an encrypted release code, via the Internet, email, or other computer network. By downloading the release code to the holster's microprocessor, the holster is enabled to permit the purchaser to access and use the firearm.

The present invention also enables a method of verifying the identity of a potential purchaser and user of a firearm prior to allowing access to and use of the firearm. For example, an authorized dealer of firearms will require the potential purchaser to provide a fingerprint or other biometric scan to be uploaded to the memory of the holster to allow the user to access the firearm according to the above-described method of use. This fingerprint or other biometric scan can then be compared to a database of fingerprint or other biometric information of convicted criminals, such as those maintained by the Federal Bureau of Investigation or various other law enforcement agencies. If the scanned fingerprint or other biometric information of the potential user matches that of a known criminal, the holster is not enabled. If the potential user successfully passes the background check and the scanned fingerprint or biometric information does not indicate a match, the holster is enabled for use with the scanned fingerprint or biometric information. In this manner, so long as the firearm is stored in the holster, the firearm cannot be used by persons obtaining stolen firearms or by persons purchasing firearms from parties other than authorized dealers having access to the encrypted information necessary to upload fingerprint or biometric information of authorized users into the holster's memory.

While the invention has been shown and described in preferred forms, it will be apparent to those skilled in the art that many modifications, additions, and deletions can be made therein without departing from the spirit and scope of the invention as set forth in the following claims.

What is claimed is:

1. A securing mechanism for locking a firearm in a housing, comprising:

two or more cooperating pivotal retaining members each having a catch surface and an engagement surface formed thereon, said retaining members being moveable between a first unlocked position wherein a cooperating portion of the housing is not constrained by said catch surfaces and the firearm can be withdrawn from the housing and a second locked position wherein said catch surfaces engage and constrain the cooperating portion of the housing to prevent withdrawal of the firearm from the housing;

said engagement surfaces configured so that, when the cooperating portion of the housing and said engagement surfaces are moved into engagement with each other while said retaining members are in said first unlocked position, the cooperating portion of the housing contacts said engagement surfaces and moves said retaining members to said second locked position;

a lock mechanism operatively coupled to said retaining members and adapted to secure said retaining members in said second position; and means for identifying an authorized user of the firearm and releasing said lock mechanism to permit withdrawal of the firearm from the housing.

2. The securing mechanism of claim 1, wherein said lock mechanism has a lock member with one or more lock arms that are adapted to engage and move said at least two retaining members from said first unlocked position to said second locked position and to secure both of said retaining members in said second locked position.

3. The securing mechanism of claim 2, wherein each of said retaining members has at least one catch arm extending therefrom with said catch surface formed thereon for engaging the cooperating portion of the housing and has a lock arm that is adapted to be engaged by at least one of said lock members of said lock mechanism.

4. The securing mechanism of claim 1, wherein said lock mechanism comprises an actuator that is operatively coupled to said retaining members and that is operable to move said retaining members to said first unlocked position.

5. The securing mechanism of claim 4, wherein said lock mechanism has a lock member that is engaged by said actuator, wherein said lock member has one or more lock arms that are adapted to engage and secure said retaining members said second locked position.

6. The securing mechanism of claim 1, wherein at least one of said engagement surfaces is disposed on at least one actuating arm extending from at least one of said retaining members.

7. The securing mechanism of claim 1, wherein said identifying means comprises a biometric sensor selected from the group consisting of fingerprint scanners, hand scanners, retinal scanners, facial recognition scanners, and voice recognition devices.

8. The securing mechanism of claim 1, further comprising the housing, wherein the securing mechanism is coupled to the housing so that when said retaining members are in said first unlocked position the firearm can be withdrawn from said housing and when said retaining members are in said second locked position the firearm is prevented from being withdrawn from said housing.

9. The securing mechanism of claim 8, further comprising a sensor for detecting whether said retaining members are in said first unlocked position or said second locked position, and communicating said locked or unlocked position status to a communications system.

10. A safety device for a firearm comprising:

a housing for receiving at least a portion of the firearm;

two or more cooperating pivotal retaining members each having a catch surface formed thereon, said retaining members being moveable between a first unlocked position wherein a cooperating portion of said housing is not constrained by said catch surfaces and the firearm can be withdrawn from said housing and a second locked position wherein said catch surfaces engage and constrain said cooperating portion of said housing to prevent withdrawal of the firearm from said housing;

a lock mechanism operatively coupled to said retaining members and adapted to secure said retaining members in said second position, wherein said lock mechanism has a lock member with one or more lock arms that are adapted to engage and move said retaining members from said first unlocked position to said second locked position and to secure both of said retaining members in said second locked position;

wherein, each of said retaining members has at least one engagement arm extending therefrom with said catch surfaces formed thereon for engaging said cooperating portion of said housing and has a lock arm that is adapted to be engaged by at least one of said lock arms of said lock mechanism; and means for identifying an authorized user of the firearm and releasing said lock mechanism to permit withdrawal of the firearm from said housing.

11. The safety device of claim 10, wherein said lock mechanism comprises an actuator and a lock member that is operatively engaged by said actuator, wherein said lock member has one or more lock arms that are adapted to engage and move said retaining members from said first unlocked position to said second locked position and to secure said retaining members in said second locked position, wherein said actuator comprises a rotary or linear actuator that is adapted to impart a rotary or linear motion to said lock member.

12. The safety device of claim 10, wherein at least one of said retaining members has a notch defined therein with said catch surface defined in said notch.

13. The safety device of claim 10, wherein said housing comprises a base and a carrier for holding the firearm, wherein said carrier is pivotally coupled to the base.

14. The safety device of claim 13, wherein said retaining members are coupled to said carrier, said cooperating portion of said housing comprises a catch associated with said base, and said catch is releasably engaged by said retaining members.

15. The safety device of claim 13, wherein said housing includes a pin and a slot defined therein that receives said pin so that said carrier pivots about said pin and said carrier can be lifted to remove said pin from said slot to remove said carrier from said base.

16. The safety device of claim 10, further comprising a sensor for detecting whether said retaining members are in said first unlocked position or said second locked position, and for communicating said locked or unlocked position status to a communications system.

17. The safety device of claim 13, wherein said retaining members, said locking mechanism, and said identification means are coupled to said carrier.

18. The safety device of claim 10, wherein said retaining members each further comprises at least one engagement surface configured so that, when said cooperating portion of said housing and said engagement surfaces are moved into engagement with each other while said retaining members are in said first unlocked position, said cooperating portion of said housing contacts said engagement surfaces and moves said retaining members to said second locked position.

19. A safety device for a firearm, comprising:

a housing for receiving at least a portion of the firearm;

at least two cooperating pivotal retaining members each having a catch surface formed thereon, said retaining members being moveable between a first unlocked position wherein a cooperating portion of said housing is not constrained by said catch surfaces and the firearm can be withdrawn from said housing and a second locked position wherein said catch surfaces engage and constrain said cooperating portion of said housing to prevent withdrawal of the firearm from said housing;

a lock mechanism operatively coupled to said retaining member and adapted to secure said retaining member in said second position, wherein said lock mechanism comprises a lock member that is movable between a first unlocked position permitting said retaining members to pivot to said first unlocked position and a second locked position securing said at least two retaining members in said second locked position; and means for identifying an authorized user of the firearm and releasing said lock mechanism to permit withdrawal of the firearm from said housing.

20. The safety device of claim 19, wherein said lock mechanism further comprises an actuator operatively coupled to said lock member and adapted to selectively move said lock member between said first unlocked position and said second locked position.

21. The safety device of claim 19, wherein said lock mechanism further comprises two lock surfaces that are defined on said two retaining members and engaged by said movable lock member, wherein said movable lock member in said second locked position engages both of said retaining members.

22. The safety device of claim 21, wherein said engagement surfaces of said retaining members are positioned between said catch surfaces and said lock surfaces of said retaining members.

23. The safety device of claim 19, wherein said retaining members, when in said second locked position, cooperate to substantially surround said cooperating portion of said housing.

24. The safety device of claim 15, wherein said carrier pivots from a second locked position with the firearm inaccessible within the base to a first unlocked position at least partially outside of the base with the firearm removable from the carrier under the force of gravity when said lock mechanism is released upon operation of said authorized user identification means.

25. A safety device for a firearm, comprising:

a housing for receiving at least a portion of the firearm, said housing comprising a base and a carrier for holding the firearm, said base including a catch, said carrier movably coupled to said base, wherein said carrier moves under the force of gravity to a first unlocked position at least partially outside of the base wherein the firearm can be withdrawn from said carrier from a second locked position with the firearm inaccessible within the base;

at least two movable retaining members each having at least one catch surface, at least one engagement surface, and at least one lock surface defined thereon, wherein said engagement surfaces are positioned between said catch surfaces and said lock surfaces;

said retaining members moveable between a first unlocked position wherein said housing base catch is not constrained by said retaining member catch surfaces so that said housing carrier moves to said first unlocked position and a second locked position wherein said retaining member catch surfaces engage and constrain said housing base catch in said second locked position to prevent withdrawal of the firearm from said housing;

said engagement surfaces configured so that, when said housing base catch and said retaining member engagement surfaces are moved into engagement with each other while said retaining members are in said first unlocked position, said housing base catch contacts said retaining member engagement surfaces and moves said retaining members to said second locked position;

a lock mechanism comprising a lock member that is movable between a first unlocked position permitting said retaining members to pivot to said first unlocked position and a second locked position engaging both of said retaining member lock surfaces and securing both of said retaining members in said second locked position; and means for identifying an authorized user of the firearm and releasing said lock mechanism to permit withdrawal of the firearm from said housing.

26. The safety device of claim 25, wherein said retaining members, when in said second locked position, cooperate to substantially surround said housing base catch.

27. The safety device of claim 25, wherein said housing includes a pin and a slot defined therein that receives said pin so that said carrier pivots about said pin and said carrier can be lifted to remove said pin from said slot to remove said carrier from said base.

28. The securing mechanism of claim 1, wherein said lock mechanism comprises a lock member that is movable between a first unlocked position permitting said retaining members to pivot to said first unlocked position and a second locked position securing said at least two retaining members in said second locked position.

29. The securing mechanism of claim 28, wherein said lock mechanism further comprises an actuator operatively coupled to said lock member and adapted to selectively move said lock member between said first unlocked position and said second locked position.

30. The securing mechanism of claim 28, wherein said lock mechanism further comprises two lock surfaces that are defined on said two retaining members and engaged by said movable lock member, wherein said movable lock member in said second motion engages both of said retaining members.

31. The securing mechanism of claim 30, wherein said engagement surfaces of said retaining members are positioned between said catch surfaces of said retaining members.

32. The securing mechanism of claim 28, wherein said retaining members, when in said second locked position, cooperate to substantially surround the cooperating portion of the housing.

* * * * *